US009273554B2

(12) United States Patent
Mungas et al.

(10) Patent No.: US 9,273,554 B2
(45) Date of Patent: Mar. 1, 2016

(54) HIGH EFFICIENCY ENERGY CONVERSION

(75) Inventors: Gregory S. Mungas, Mojave, CA (US); Christopher Mungas, Plymouth, CA (US); Gregory Peters, Palmdale, CA (US); Kenneth Doyle, Quartz Hill, CA (US)

(73) Assignee: Carol E. Mungas, Great Falls, MT (US)

( * ) Notice: Subject to any disclaimer, the term of this patent is extended or adjusted under 35 U.S.C. 154(b) by 346 days.

(21) Appl. No.: 13/197,148

(22) Filed: Aug. 3, 2011

(65) Prior Publication Data

US 2012/0031091 A1 Feb. 9, 2012

Related U.S. Application Data

(60) Provisional application No. 61/370,376, filed on Aug. 3, 2010.

(51) Int. Cl.

| | |
|---|---|
| ***F02G 1/04*** | (2006.01) |
| ***F01B 9/02*** | (2006.01) |
| ***F02G 1/053*** | (2006.01) |
| ***F01B 9/06*** | (2006.01) |

(52) U.S. Cl.

CPC . *F01B 9/023* (2013.01); *F01B 9/06* (2013.01); *F02G 1/04* (2013.01); *F02G 1/053* (2013.01); *F02G 2290/00* (2013.01)

(58) Field of Classification Search

CPC ..... F01B 29/10; F01B 9/06; F01B 9/023; F01B 2009/061–2009/068; F02G 2270/425; F02G 1/04; F02B 2275/36

USPC ..... 60/508–531, 594, 671; 74/25–62, 74/567–569

See application file for complete search history.

(56) References Cited

U.S. PATENT DOCUMENTS

| | | | | |
|---|---|---|---|---|
| 1,505,856 A * | 8/1924 | Briggs | ..... | 74/50 |
| 2,407,859 A * | 9/1946 | Wilson | ..... | 74/55 |
| 4,501,122 A * | 2/1985 | Cutler | ..... | 62/116 |

(Continued)

FOREIGN PATENT DOCUMENTS

| | | | |
|---|---|---|---|
| DE | 1205788 B | * | 11/1965 |
| DE | 10021747 A1 | | 11/2001 |

(Continued)

OTHER PUBLICATIONS

International Searching Authority, U.S. Patent and Trademark Office; International Search Report for PCT/US11/046396; dated Jan. 16, 2012, 4 pages.

*Primary Examiner* — Thomas Denion
*Assistant Examiner* — Laert Dounis
(74) *Attorney, Agent, or Firm* — HolzerIPLaw, PC

(57) ABSTRACT

A high efficiency energy conversion system disclosed herein incorporates a piston assembly including a sealed cylinder for storing a working fluid and an energy conversion element attached to the piston assembly. A kinematic mechanism such as a cam lobe or a scotch yoke may be used as the energy conversion element. In one implementation, the kinematic mechanism may be configured to provide rapid piston expansion in a manner so as not to allow the expanding working fluid inside the piston to achieve thermodynamic equilibrium. In an alternate implementation, the kinematic mechanism is further adapted to generate a compression stroke in a manner to provide the working fluid inside the piston to achieve thermodynamic equilibrium conditions throughout the compression stroke.

27 Claims, 20 Drawing Sheets

(56) References Cited

U.S. PATENT DOCUMENTS

| | | | | |
|---|---|---|---|---|
| 4,693,087 | A | 9/1987 | Lagow | |
| 4,934,344 | A * | 6/1990 | Perr | 123/78 F |
| 5,027,602 | A | 7/1991 | Glen et al. | |
| 5,146,750 | A * | 9/1992 | Moscrip | 60/517 |
| 5,899,067 | A | 5/1999 | Hageman | |
| 6,272,855 | B1 * | 8/2001 | Leonardi | 60/513 |
| 7,121,236 | B2 * | 10/2006 | Scuderi et al. | 123/70 R |
| 7,296,408 | B2 * | 11/2007 | Pierce | 60/522 |
| 7,775,042 | B1 | 8/2010 | Tice | |
| 2002/0039280 | A1 * | 4/2002 | O'Connor et al. | 361/690 |
| 2004/0060294 | A1 | 4/2004 | Yatsuzuka et al. | |
| 2007/0220881 | A1 | 9/2007 | Komaki et al. | |
| 2009/0301089 | A1 | 12/2009 | Bollinger | |
| 2011/0030366 | A1 * | 2/2011 | Liu | 60/518 |

FOREIGN PATENT DOCUMENTS

| | | |
|---|---|---|
| JP | 2007-025734 | 2/2007 |
| RU | 2157459 C1 | 10/2000 |
| WO | 2007025517 C1 | 3/2007 |

* cited by examiner

HIGH EFFICIENCY ENERGY CONVERSION

CROSS-REFERENCE TO RELATED APPLICATIONS

The present application claims benefit of priority to U.S. Provisional Application No. 61/370,376, entitled "High Efficiency Energy Conversion" and filed on Aug. 3, 2010, which is incorporated herein by reference for all that it discloses and teaches.

BACKGROUND

The efficiency of thermodynamic systems used for converting thermal energy into work or other useful energy forms is most commonly limited by the theoretical Carnot cycle efficiency for cases of a constant working fluid operating in a thermal engine. However, more complex thermodynamic systems, such as fuel cells, can violate maximum Carnot cycle efficiencies for thermal engines by passing energy through a system where the working fluid chemically changes over time. Nevertheless, these systems are still limited in the most general sense to the assumption of operating near local thermodynamic equilibrium (quasi-equilibrium) at every point in the thermodynamic cycle.

Achieving thermodynamic equilibrium at a point in a thermodynamic cycle requires the rates of heat and mass transport (and chemical reaction for the cases of chemically reacting fluids) for equilibrating a system to be much faster than the rates of change that occur in the system. For example, in a gas piston, the molecular collision rates inside the gas for equilibrating the gas are typically very high relative to piston velocities. As a result, the bulk gas density, pressure and temperature effectively equilibrate almost instantaneously relative to the rate of piston motion, and therefore, the gas tends to remain in thermodynamic quasi-equilibrium (near equilibrium) at every spatial location occupied by the gas. Accordingly, the thermodynamic equilibrium assumption remains valid, and the efficiency of the thermodynamic system remains constrained within the traditional limit.

SUMMARY

Among other things, implementations described and claimed herein provide an opportunity to increase thermal conversion efficiencies of a power cycle energy conversion system beyond such a traditional limit by operating a substantial portion of the overall power cycle with a non-equilibrium thermodynamic process. Implementations are described that produce meta-stable, bulk non-equilibrium states during the non-equilibrium thermodynamic portion of the power cycle. Although these meta-stable states are transient, they may be operated over a substantial portion of the power cycle by operating the power cycle at rates with associated time scales (e.g., the period of the piston cycle) that are comparable to or shorter than the lifetimes of the meta-stable states.

These and various other features and advantages will be apparent from a reading of the following detailed description of implementations described and recited herein.

BRIEF DESCRIPTIONS OF THE DRAWINGS

A further understanding of the nature and advantages of the present invention may be realized by reference to the figures, which are described in the remaining portion of the specification. In the figures, like reference numerals are used throughout several figures to refer to similar components. In some instances, a reference numeral may have an associated sub-label consisting of a lower-case letter to denote one of multiple similar components. When reference is made to a reference numeral without specification of a sub-label, the reference is intended to refer to all such multiple similar components.

DETAILED DESCRIPTIONS

Figure 1:
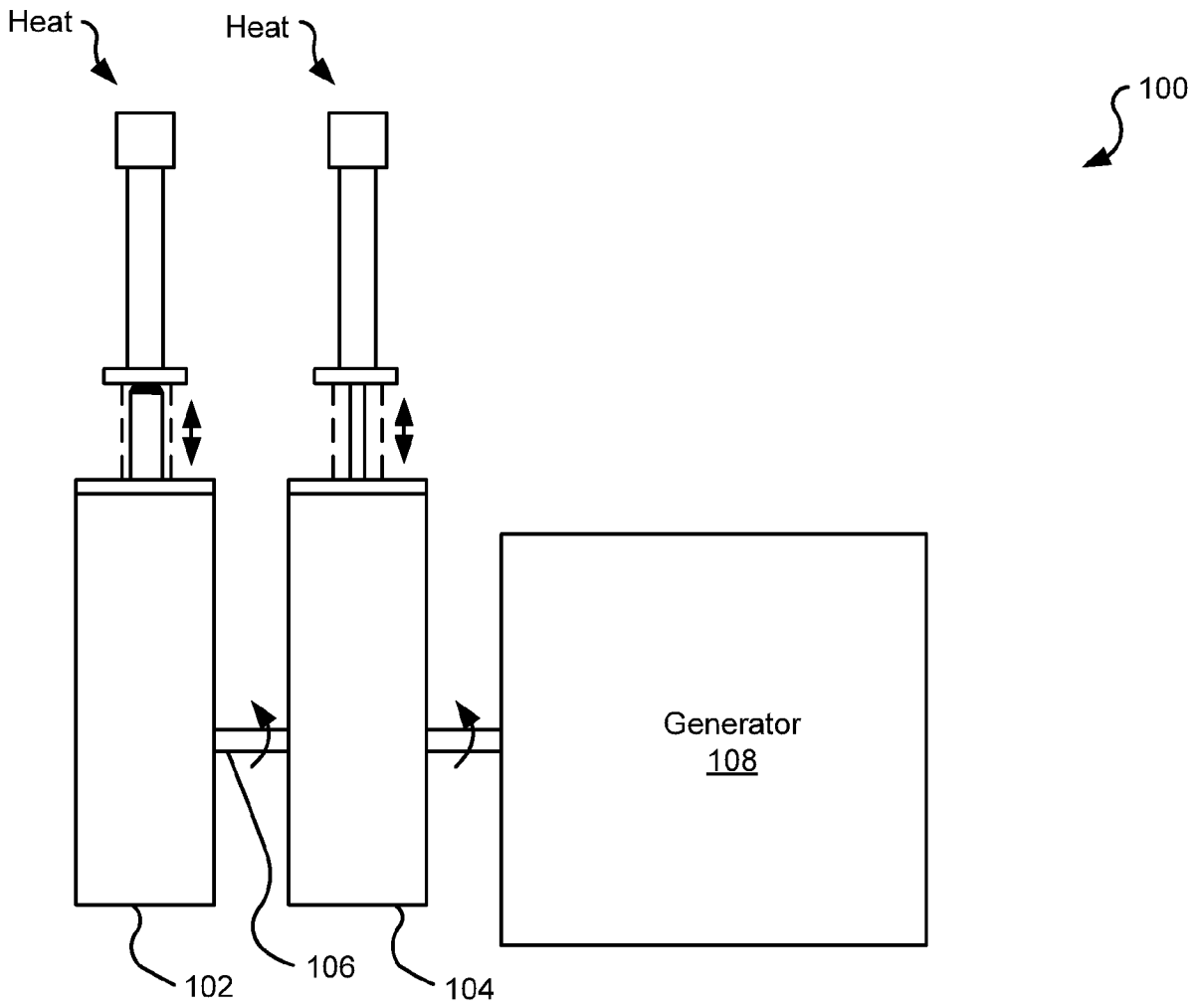
FIG. 1 is a block diagram of an example high efficiency energy conversion (HEEC) system.

Traditional thermodynamic systems do not incorporate a non-equilibrium process in the design of the thermodynamic cycle. In contrast, implementations disclosed herein violate the traditional thermodynamic equilibrium assumption by introducing non-equilibrium processes into a thermodynamic cycle (e.g., by effectively slowing down a thermodynamic equilibration process so that it is slower relative to the bulk rates of change in a portion of the power cycle). Introducing non-equilibrium processes into a thermodynamic cycle can be used to strategically improve thermal conversion efficiency in the system in a manner very crudely analogous to the operation of a fuel cell, which can achieve higher conversion efficiencies than Carnot cycle analysis for a thermal engine would suggest. In other words, incorporating bulk non-equilibrium thermodynamics processes into power cycle design provides opportunities for improving conversion of thermal energy into mechanical work compared to cycles that are restricted to operate in local thermodynamic equilibrium for every portion of the power cycle.

Bulk meta-stable, non-equilibrium thermodynamic states are characterized as states that significantly deviate from and/or are not accurately described by relationships between intensive thermodynamic properties (e.g. pressure, temperature; bulk fluid density) associated with thermodynamic equilibrium conditions. These states are not stable, but rather meta-stable, and will decompose into a state described by thermodynamic equilibrium conditions typically over a relatively short period of time. To generate meta-stable, bulk non-equilibrium states, the thermodynamic equilibrium states of a fluid must be momentarily violated. In practice, this is typically difficult to achieve and is rarely witnessed in nature.

Processes that produce bulk meta-stable, non-equilibrium thermodynamic states are differentiated from more traditional non-equilibrium thermodynamic processes. The latter are typically due to systems that establish spatial gradients of at least one of the thermodynamic properties in a system (most commonly temperature) and will always degrade power cycle conversion efficiency by production of entropy. These more traditional non-equilibrium processes still have working fluids that are at or near local thermodynamic equilibrium at localized points within the system (i.e., the fluid's local pressure, temperature, and density at any given spatial location can be described by equilibrium relationships among the thermodynamic state variables). In a gas piston example, the gas near the walls of the cylinder may be at a slightly different temperature than the core temperature of the cylinder gas due to heat transfer to the cylinder wall. Nevertheless, at any given spatial location in the gas cylinder, the relationships among pressure, local fluid density, and local temperature are still well described by a model assuming local thermodynamic equilibrium. Bulk non-equilibrium thermodynamic states, on the other hand, can exist without substantial spatial gradients of thermodynamic properties in a system and can actually improve thermal conversion efficiency of a power system with a carefully designed power cycle.

In an exemplary HEEC process disclosed herein, one method for achieving a meta-stable, non-equilibrium process over a portion of the power cycle is to cause the working fluid to go through a fluid phase change. In one HEEC power cycle implementation, a portion of the power cycle crosses a phase change boundary (i.e. saturated liquid/gas boundary) to effect this phase change. For example, piston expansion can be designed such that there is insufficient time for the gas molecules to equilibrate and condense out of the gas phase relative to the rate of change of state associated with the piston expansion. As a result the cylinder pressure associated with the meta-stable, non-equilibrium process remains higher compared to the equilibrium process. This higher cylinder pressure produces additional work on the piston face for a given volumetric change in the piston cylinder compared to an equilibrium or quasi-equilibrium process. This additional expansion work extracted out of the cylinder volume draws additional energy from the working fluid and, as a result, produces a lower energy state at the end of the piston expansion period as compared to the equilibrium or quasi-equilibrium process. With sufficient dwell time to complete condensation and allow thermodynamic equilibrium to be attained, the meta-stable state ultimately collapses into this lower energy thermodynamic equilibrium state. Reversing this process (e.g., during a slower piston compression stroke), the piston is allowed to maintain quasi-equilibrium conditions that produce lower cylinder pressures as compared to the meta-stable non-equilibrium expansion process utilized during the piston power stroke.

When considering the working fluid to be used in a specific phase change meta-stable non-equilibrium HEEC cycle disclosed herein, the working fluid properties near the critical temperature are considered (e.g., the critical temperature represents a temperature above which a fluid can no longer be a liquid, regardless of pressure). One factor to be considered is whether the critical temperature of the working fluid in relative close proximity to the input temperature from the heating source and at a lower temperature than the heat input. Another factor to be considered is the shape of the saturated liquid/gas boundary relative to the profile of expansion of the working fluid has to support condensation of the working fluid through an expansion process.

An additional factor of the working fluid to be considered is a complex non-equilibrium characteristic tied to condensation rates to help ensure and optimize the meta-stable non-equilibrium expansion process. However, this characteristic also supports sufficiently high condensation rates to equilibrate the meta-stable state at the end of expansion back into an equilibrium state. This non-equilibrium characteristic of the working fluid may be observed in an experimental system that has similar geometric, temporal, and thermal boundary conditions to which a real powerplant would be designed.

Working fluids also have properties that, for a given engine size, allow piston assemblies to run at slower rates or generate more power for a given engine size. Allowing longer piston cycle periods for a given HEEC engine power output may, in some cases, be beneficial for allowing additional time for transferring heat into the working fluid near TDC and allowing longer timescales for condensation to occur near BDC.

Vapor pressure is one of these properties helpful in optimizing engine power output. Higher vapor pressures produce more work output for a given volume change and typically allows more energy to be extracted from the working fluid during an expansion process. The vapor pressure of the working fluid typically falls off quickly with reductions in temperature relative to changes in pressure seen with changes in gases at temperatures above the critical temperature. This rapid reduction in gas pressure with changes in temperature below the critical temperature occurs because condensation effectively removes gas molecules that produce gas pressure. However, with slower condensation rates associated with the meta-stable non-equilibrium expansion process, this reduction in pressure in the cylinder is not experienced to the same extent as it is in an equilibrium expansion process starting from the same state point.

The constant volume volumetric specific heat (energy per unit volume necessary for heating a fluid under constant volume conditions) of the multi-phase working fluid is also important for maximizing the power output of the engine or allowing the engine to run at slower rates for a given size. Higher constant volume volumetric specific heats increase the power output or thermal cooling power of the exemplary HEEC engine for a given driveshaft RPM. This constant volume volumetric specific heat is evaluated in a two-phase fluid regime at fluid densities that are comparable to those used in the power cycle when the piston is near TDC. These volumetric specific heats divided by the working fluid density are similar in principle but different in actual numeric value than the constant volume specific heat (per unit mass) more commonly tabulated for gases. The differences among these values are due to the complex process of two-phase fluid vaporization under constant volume conditions near the critical temperature.

Example working fluids that may be used with this type of cycle may include without limitation a refrigerant, such as Octafluoropropane (R218); a molten salt, such as a liquidfluoride salt; a molten metal, such as liquid mercury; etc. Specifically, refrigerants, such as R218, may work in the temperature range of −50 to 250 degrees centigrade, although such range need not be strictly limiting. The molten salts may work in the temperature range of 250 to 400 degrees centigrade, although such range need not be strictly limiting. For example, in another example, the molten metals may work in the temperature range of 400 to 1500 degrees centigrade. Of these working fluids, mixed liquid/vapor mercury has the lowest vapor pressure being around 80-90 pounds per square inch absolute (PSIA) near its critical temperature but allows operation of the HEEC power cycle at elevated temperatures.

FIG. 1 is a block diagram of an example high efficiency energy conversion (HEEC) system 100, which converts energy from a first form into another form at a high efficiency. The example HEEC system 100 includes one or more conversion engines 102, 104 that receive energy in the form of heat input to the working fluid. This heat can be produced from many sources, including without limitation, chemical energy, electrical energy, nuclear energy, heat transferred from a working fluid, etc. More specifically, the heat energy may be provided by a source that generates energy from bio-fuels, gasoline, solar thermal energy, geothermal energy nuclear power plant energy, or other sources of heat energy, such as thermal industrial waste heat or any other applicable waste heat.

In one implementation, HEEC systems and related processes may be used to cool systems by drawing out and converting waste heat into useful work. The work conversion process allows a temperature gradient to be established between a heat source to be cooled and the thermal input to the HEEC system.

In an implementation of the energy conversion system 100, each of the conversion engines 102, 104 includes a piston assembly having a sealed cylinder for storing a working fluid. Each of the piston assemblies may be attached to a kinematic mechanism configured to provide rapid piston expansion in a manner that prevents the expanding working fluid inside the sealed cylinder from achieving thermodynamic equilibrium, at least for a portion of the thermodynamic cycle. In one implementation of the energy conversion system 100, the kinematic mechanism of each of the conversion engines 102, 104 is attached to a driveshaft 106 to drive a generator, a motor, etc., represented by numeral 108 herein. For example, the energy conversion system 100 may convert input heat into output energy 110 (e.g., electricity) generated by the generator 108. The operation of the conversion engines 102, 104 is described in further detail in FIGS. 2-7 below.

The piston assembly is an example of an energy conversion mechanism that generates power through volumetric expansion of a working fluid.

Figure 2:
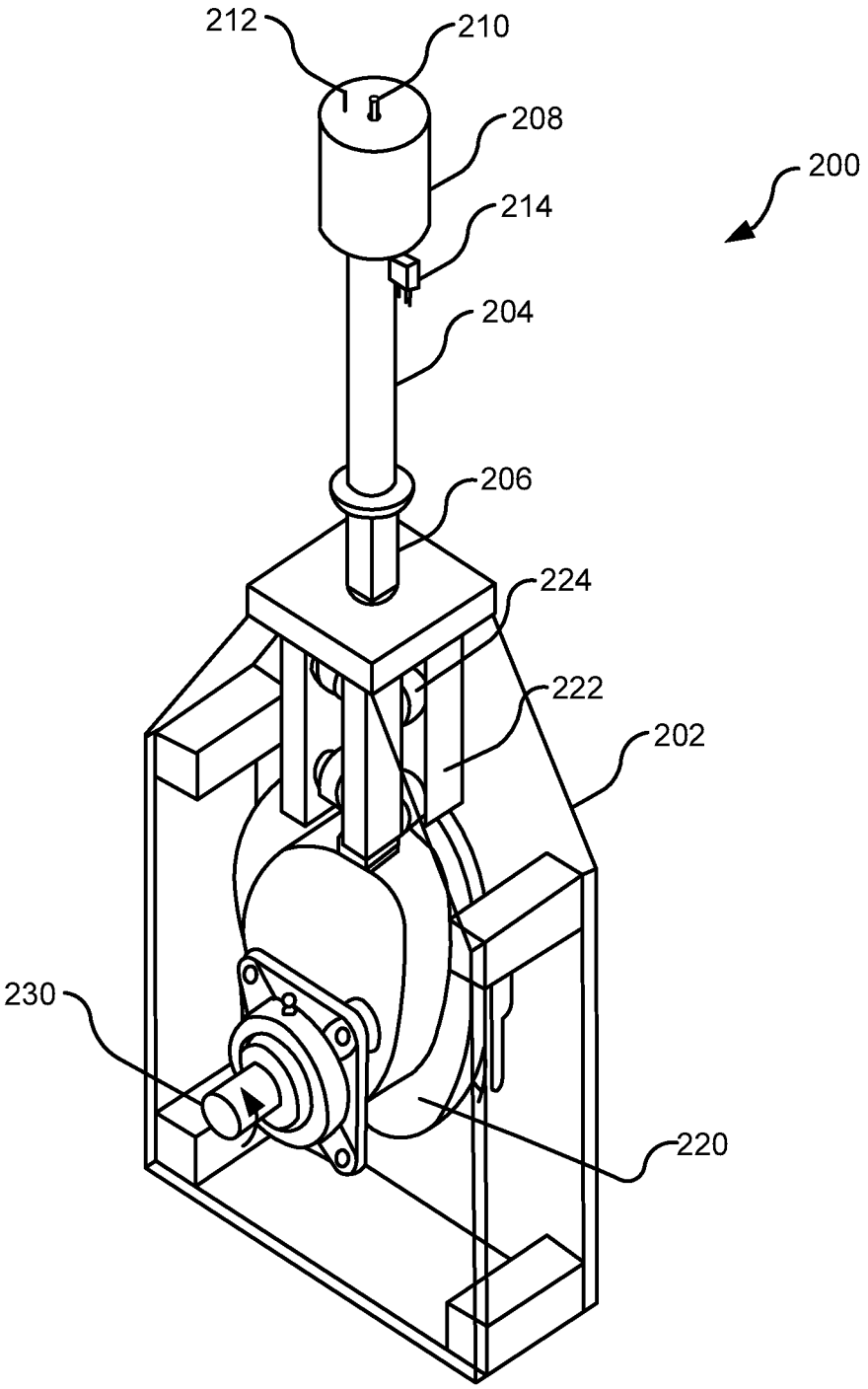
FIG. 2 illustrates a three-dimensional view of an example high efficiency energy conversion (HEEC) engine.

FIG. 2 illustrates a three-dimensional view of an example high efficiency energy conversion (HEEC) engine 200. The HEEC engine 200 may be used in the energy conversion system as an energy conversion engine (e.g., converting heat to rotational motion to electricity). The HEEC engine 200 includes a body 202 for housing one or more components of the HEEC engine 200 as further described below. The body 202 may be attached to a piston cylinder 204 via a support member 206. In one implementation, the support member 206 is a hollow tube that can accommodate a piston assembly moving within the body 202 and the piston cylinder 204. However, in alternate embodiments, different form of support member, such as connecting rods, may also be used.

The piston cylinder 204 may be made of material including without limitation ferrous and non-ferrous metals and their alloys, carbon and/or carbon composite materials, etc. The piston cylinder may also be provided with a liner on the inner surface, wherein such a liner is made of ferrous and non-ferrous metals that are treated with corrosion inhibitors. The piston assembly is adapted for movement of a piston inside the piston assembly with minimal friction. In one implementation of the HEEC engine 200, an upper end of the piston cylinder 204 is attached to an insulated head block 208 that, for example, may house a micro-fluidic heat exchanger (not shown in FIG. 2) or other efficient heat exchanger. An example micro-fluidic heat exchanger is described in further detail in FIG. 3 below, although other energy conduits structures may be employed. In addition to conducting energy into the HEEC working fluid in the piston cylinder, the insulated head block 208 may aid in insulating the HEEC engine 200 to minimize heat loss from a heat source to the external environment. Without such an insulated head, the HEEC engine would still function in most configurations, but heat loss may lower its thermal conversion efficiency.

In one implementation, the insulated head block 208 provides an inlet port 210 for input energy flow (e.g., embodied in a hot water or steam) and a outlet port 212 to allow this HEEC-cooled fluid stream to exit the insulated head block 208. The insulated head block 208 is also provided with a working fluid inlet port (not shown in FIG. 2) used to insert a piston working fluid into the piston cylinder 204. The working fluid inlet port may be located at the top of the insulated head block 208, on a side surface of the insulated head block 208, elsewhere on the system 200.

In one implementation, the piston cylinder 204 is hermetically sealed after the working fluid is introduced to the piston cylinder 204, although other methods and structures for preserving the working fluid and maintaining a closed system 200 may be employed. The HEEC engine 200 illustrated in FIG. 2 also includes a chamber thermocouple 214 that can be used to measure the temperature of the working fluid inside the insulated head block 208. In one implementation, a micro-fluidic heat exchanger of the insulated head block 208 allows the heat coming from the inlet port 210 to be efficiently transferred to the working fluid within the piston cylinder 204.

The body 202 may house a kinematic mechanism 220 attached to the piston assembly to convert the energy from the piston into energy for turning a crankshaft or for some other result. In the illustrated implementation of the HEEC engine 200, the kinematic mechanism 220 is represented by a cam lobe, although other mechanisms may be employed. The kinematic mechanism 220 is attached to the piston assembly, which is housed partially within the body 202 and partially within the piston cylinder 204. As an example, the kinematic mechanism 220 may be attached to a piston rod of the piston assembly.

In one implementation, the body 202 also includes roller housing 222 that is attached to the body 202. The roller housing may include rollers 224 that can be used as a vertical guide for the piston assembly. Moreover, the piston assembly may be movably attached to the kinematic mechanism 220 via a rod clevis (not shown here).

According to one implementation, a geometry of the kinematic mechanism 220 is configured to provide the piston assembly an expansion cycle that does not allow the expanding working fluid in the piston cylinder 204 to achieve thermodynamic equilibrium throughout all or a substantial portion of the expansion stroke. As further illustrated in detail in FIGS. 3-7 below, the kinematic mechanism 220 and the piston assembly together cause the piston assembly to move through a series of expansion and compression cycles, which causes the kinematic mechanism 220 to rotate around its center. Such rotation of the kinematic mechanism 220 causes circular movement of a drive shaft 230, which in the illustrated implementation occurs in the same rotational direction.

Figure 3:
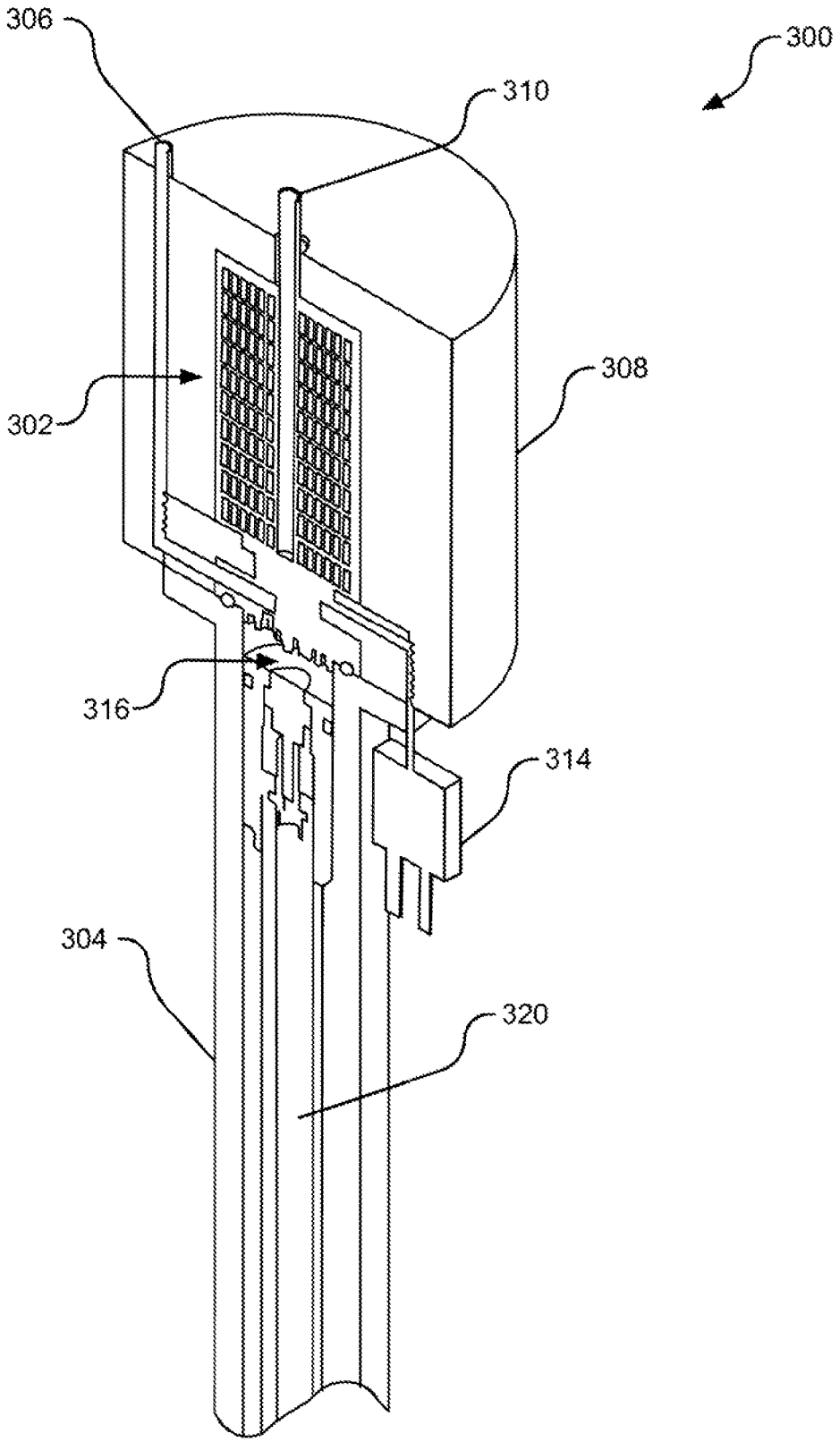
FIG. 3 illustrates a cross-sectional view of a piston insulated head block of an example HEEC engine.

FIG. 3 illustrates a cross-sectional view of a piston insulated head block 300 of an example HEEC engine. A cylinder 304 and the piston insulated head block 300 combine to convert heat energy, which is input to the piston insulated head block 300 and the cylinder 304 into another form of energy (e.g., energy of a turning driveshaft). The insulated head block 308 is configured, in one implementation, to house a micro-fluidic heat exchanger 302 that is designed to efficiently draw heat from the heat source fluid (e.g., steam that is input to the piston insulated head block 300). A inlet port 310 allows a source of heat, such as steam to be input to the micro-fluidic heat exchanger 302 in the insulated head block 300. The piston cylinder volume may receive working fluid from a working fluid input port that has a fluid access anywhere inside the piston cylinder volume throughout the piston's range of motion.

As illustrated in FIG. 3, various fluid passages of the micro-fluidic heat exchanger 302 may be employed to carry heat from the heat source fluid, such as steam, to the working fluid inside the piston cylinder, thus allowing heat to be efficiently transferred from the heat source fluid to the working fluid. A chamber thermocouple 314 may be attached to the internal chamber 316 to allow measurement of the average temperature in the insulated head block 308. The piston cylinder 304 is further illustrated as housing a piston 320 that moves along the length of the piston cylinder 304 in response to the expansion of the working fluid. Various movement cycles of the piston 320 are further illustrated in detail below in FIGS. 4-7.

FIGS. 4-7 illustrate an example HEEC engine 400 in states 1-4 of its power cycle. Specifically, FIGS. 4-7 illustrate the positions of the piston and the kinematic mechanism of the HEEC engine in states 1-4 of its power cycle. For clarity, FIGS. 4-7 use the same numerals in illustrating similar components, although FIGS. 4-7 may represent different implementations.

Figure 4:
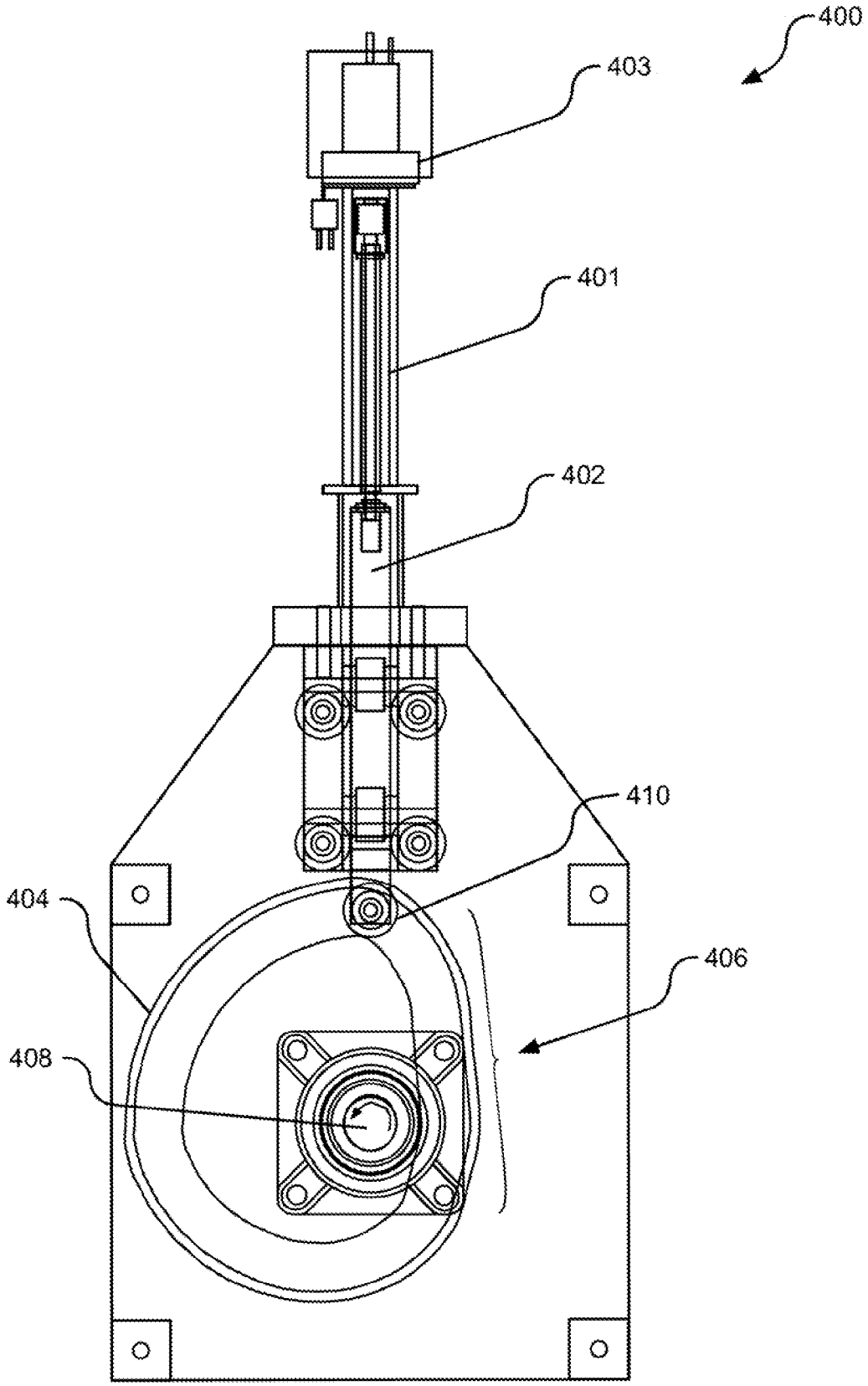
FIGS. 4-7 illustrate an example HEEC engine in states 1-4 of its power cycle.

Specifically, FIG. 4 illustrates the HEEC engine 400 in state 1. In state 1, a piston 402 is at its top dead center (TDC) position. In this state, a kinematic mechanism 404 is illustrated to have its relatively flat surface 406 substantially vertically aligned in the same direction as the direction of the movement of the piston 402, and the piston 402 is in a full compression position at the top of a piston cylinder 401. Transfer of heat to the working fluid in the piston cylinder 401 via a heat exchanger 403 has caused the working fluid to vaporize and build to peak cylinder pressure. The expansion of the working fluid from state 1, together with the relatively flat surface of the kinematic mechanism 404, causes a very rapid vertically downward movement of the piston 402 relative to the piston cylinder 401 and the heat exchanger 403 as the power cycle transitions to state 2.

Such movement of the piston 402 from state 1 to state 2 is also identified as the HEEC power stroke for the HEEC engine 400. The rapid expansion of the working fluid and the alignment of the relatively flat surface of the kinematic mechanism 404 with the direction of the movement of the piston 402 cause the power stroke to be completed relatively rapidly in comparison to equilibrium rates within the cylinder, in about 90 degrees of the total rotation of the driveshaft 408. For example, the expansion stroke may be designed so that the volume rate of change in the piston is faster than the rate of condensation and the rate of mass transport of gas molecules to liquid condensation nuclei, such that thermodynamic equilibrium is not achieved during the piston expansion process.

In one embodiment, the gas molecules operate in a regime near a phase boundary, such as a gas/liquid interface. During the rapid expansion, the gas is supercooled through work extraction of the expanding gas. This supercooled gas, through at least a portion of the expansion stroke, would under normal thermodynamic equilibrium conditions cross the saturated gas line of a phase diagram and as a result, the cylinder volume would consist of both a liquid and gas vapor in ratios described by thermodynamic equilibrium. Traditionally, due to the very high kinetic velocities of molecules in a gas, gases typically have much higher bulk fluid equilibration rates than the rate at which an expanding piston volume can change.

By crossing a phase change boundary during the expansion process, however, new time-limiting condensation and/or vapor transport processes are created that have much slower rate for equilibration than the natural gas equilibration rates and, even more importantly, the piston expansion rates. Therefore, there is insufficient time during the rapid piston expansion process for the supercooled gas to fully condense as much gas into liquid as equilibrium thermodynamics would predict. As a result, the cylinder pressure during the expansion stroke is higher with this non-equilibrium metastable state of the working fluid than would be the case if some of the gas molecules were allowed to condense into much denser liquid droplets. This higher piston cylinder pressure allows more piston work to be extracted than would be the case for an equilibrium process. Furthermore, the greater amount of piston work extracted from the working fluid also contributes to cooling the working fluid more than would be the case for a thermodynamic equilibrium expansion process. In one implementation, the vapor diffusion rate is dependent on the much longer timescale necessary for vapor to move radially through the gas column to condense on the inside cylinder wall, where liquid condensation may occur.

Figure 5:
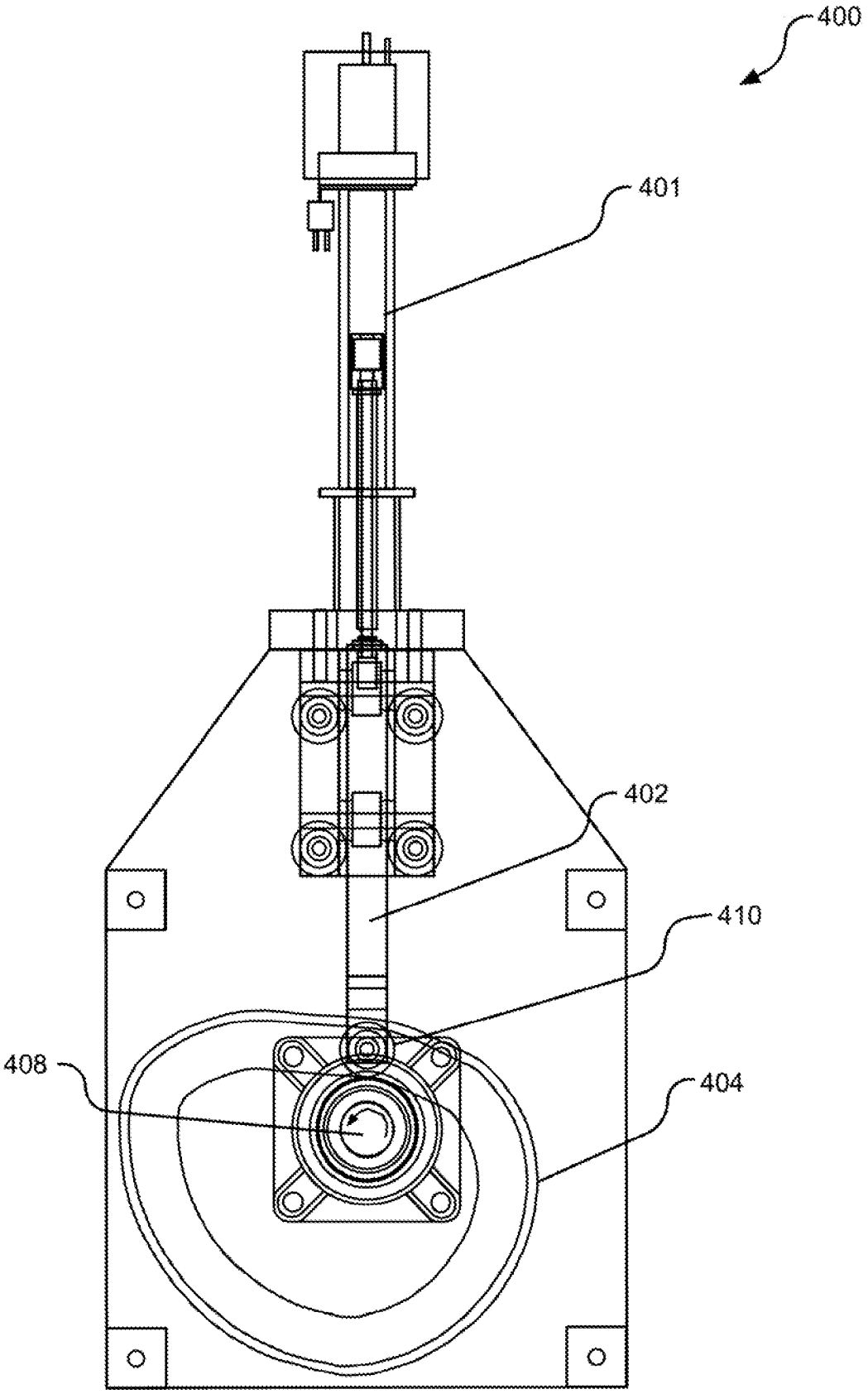

FIG. 5 illustrates an example HEEC engine 400 in state 2. In state 2, the piston 402 is at its bottom dead center (BDC) position. As illustrated in FIG. 5, the relatively flat surface 406 of the kinematic mechanism 404 is close to perpendicular to the direction of the movement of the piston 402. Therefore, between state 2 and state 3, illustrated below in FIG. 6, the piston 402 is generally at the same position, namely close to the BDC. Such period between state 2 and state 3 is referred to herein as the bottom dwell period. During the bottom dwell period, the cam profile radius as measured from the center of the driveshaft to the contact point of a cam follower 410 is relatively constant over the angle that the drive shaft traverses, such that the piston remains near BDC. The bottom dwell period allows sufficient time for the supercooled gas to nearly fully equilibrate and condense out the liquid portion of the working fluid, thus lowering the cylinder pressure for the compression stroke at the maximum cylinder volume. The bottom dwell period causes the piston cylinder to have relatively low pressure and a higher cylinder volume for the working fluid inside the piston cylinder, relative to other states in the power cycle. In one implementation of the HEEC engine 400, the kinematic mechanism 404 may be configured to provide a bottom dwell period of approximately 30 degrees of the rotation of the driveshaft 408, although other configurations are contemplated. In one implementation, the bottom dwell time may be optimized so that the working fluid condenses under a transport-limited process.

To facilitate rapid re-condensation rates during the bottom dwell period, an implementation of the HEEC engine 400 may provide the inner surface of the piston cylinder 401 to be made of material that allows such rapid condensation of gas molecules on its surface, particularly once the piston is near or in the bottom dwell period. For example, glass, metal, etc., may be examples of such inner surface materials. Because the working fluid inside the piston cylinder may condense according to a transport-limited process, droplets of the working fluid may collect on the inner surface of the piston cylinder 401. Furthermore, this piston cylinder 401 may have regions of the inner cylinder wall that are made of different materials to facilitate condensation occurring near BDC more so than at other portions of the expansion cycle.

Figure 6:
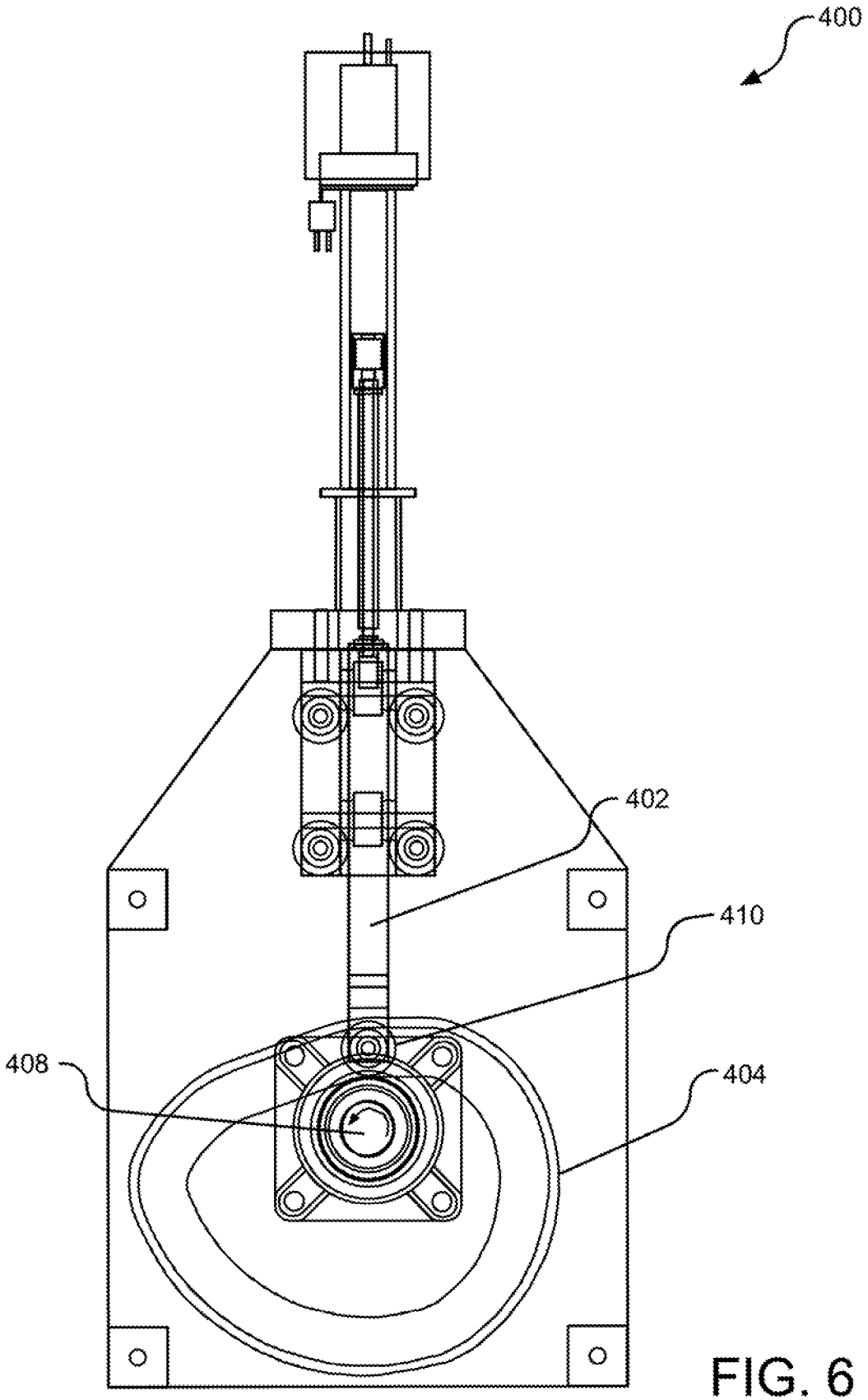

FIG. 6 illustrates an example HEEC engine 400 in state 3. In state 3, the piston 402 is still at its BDC. However, at this state, all or nearly all of the condensable fluid has condensed onto solid surfaces such that the cylinder pressure in the cycle is at its minimum. At this point, the bottom end of the piston 402 is beginning to start moving away from the relatively flat surface 406 of the kinematic mechanism 404 and the piston is beginning to compress. In other words, state 3 marks the end of the BDC dwell time. During the compression stroke of the HEEC engine 400 between state 3 and state 4, the piston moves from its BDC toward its TDC. In an implementation of the HEEC engine 404, the movement of the piston 402 from the BDC to TDC, (i.e., the movement from state 3 to state 4) may be as long as 150 degrees of the rotation of the driveshaft 408.

Figure 7:
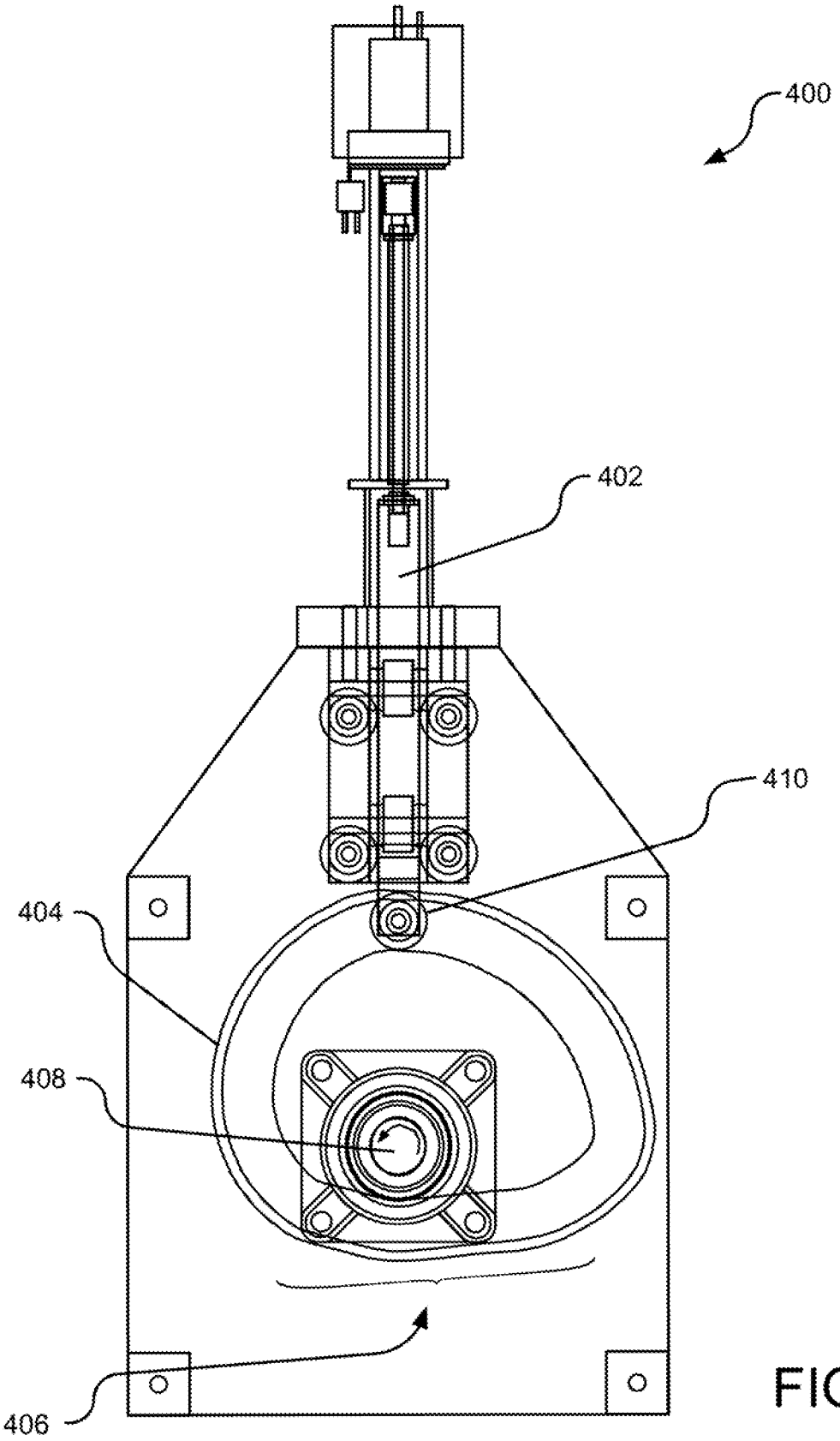

FIG. 7 illustrates an example HEEC engine 400 in state 4. During state 4, the relatively flat surface 406 of kinematic mechanism 404 is relatively perpendicular to the direction of motion of the piston 402 and the radius of the cam profile, as measured from the center of the driveshaft to the contact point with the cam-follower wheel 410, is nearly constant. As a result, during this cycle, the piston remains at the TDC for a comparatively long period. This period of the HEEC engine 400 is referred to as the "top dwell period." In one implementation, the piston remains at the TDC for up to ninety degrees of driveshaft rotation. The configuration of the kinematic mechanism 404 may be optimized in a manner so that the extended top dwell period at the TDC allows time for maximum heat transfer from the heated cylinder head into the working fluid. Note that during the top dwell period, the working fluid is compressed in the internal chamber (e.g., the internal chamber 316 as shown in FIG. 3) close to the microfluidic heat exchanger 302. Toward the completion of state 4 of the HEEC cycle, the relatively flat surface 406 of the kinematic mechanism 404 moves to a position that is relatively aligned with the downward motion of the piston 402 (as shown in FIG. 4). Between state 4 and state 1, the extended heating of the working fluid during the top dwell period causes the working fluid to vaporize and the cylinder pressure to increase to a maximum at state 1.

Figure 8:
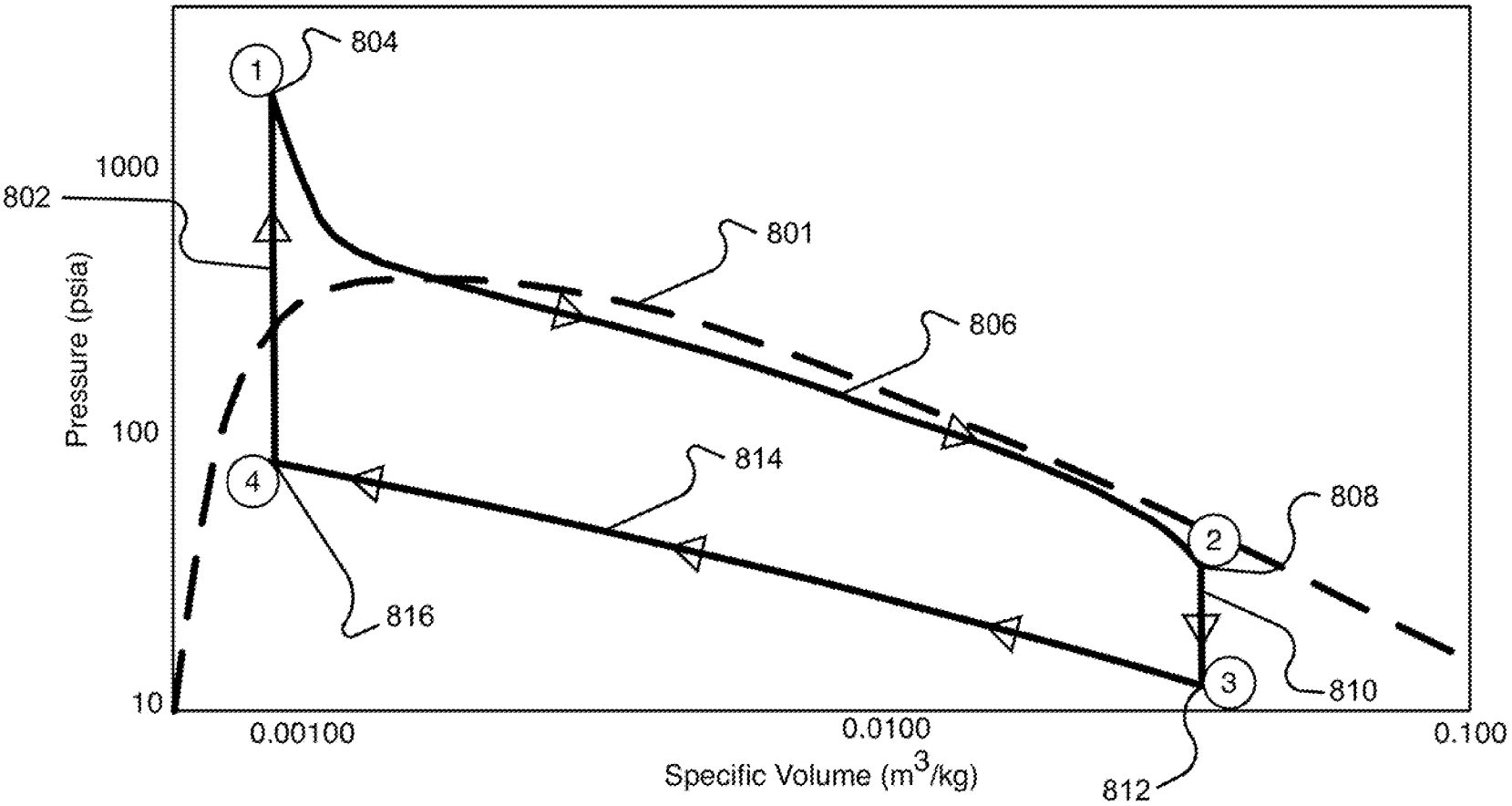
FIG. 8 illustrates a pressure-volume diagram of an example HEEC engine during the various states of its power cycle.

FIG. 8 illustrates a pressure-volume (PV) diagram 800 of an example HEEC engine during the various states of its power cycle. In the diagram 800, this power cycle overlays the saturated liquid/gas boundary of the piston working fluid (denoted with dashed line 801). Specifically, the PV diagram 800 illustrates experimentally measured non-equilibrium piston expansion profiles 806 coupled with an equilibrium thermodynamic cycle analysis of the additional equilibrium processes (shown as graphed lines 802, 810, and 814) to close the HEEC cycle. The equilibrium analysis was conducted using a commercial thermodynamic software package for all other states. The PV diagram 800 can also be related to the state diagrams illustrated in FIGS. 4-7. As illustrated in FIG. 8, the state 1 (denoted by 804) of the HEEC engine generally corresponds to the end of the heat addition period 802. State 2 (denoted by 808) of the HEEC engine generally corresponds to the end of the piston expansion period 806. State 3 (denoted by 812) of the HEEC engine generally corresponds to the end of the HEEC optimized bottom dwell period 810. State 4 (denoted by 816) of the HEEC engine generally corresponds to the end of the isentropic compression profile 814.

Specifically, during the heat addition period 802, the piston remains near the top dwell center (TDC) causing the volume of the working fluid to be nearly constant. However, during this period, the addition of heat to the working fluid causes rapid increase in the pressure of the working fluid. At the end of the heat addition period 802, the piston starts its rapid expansion period 806. In an illustration of the HEEC engine disclosed herein, the rapid expansion of gas during the expansion period 806 is achieved by allowing the piston to move toward a bottom dead center (BDC) crossing a saturated liquid/gas phase transition in order to create a condensation and/or mass diffusion transport limited process that does not allow the gas to fully equilibrate into its equilibrium two-phase fluid during at least a substantial portion of the expansion period 806. Subsequently, during period 810, the piston of the HEEC engine is allowed to remain at the BDC, therefore, this period may also be referred to as the BDC dwell period. Because of the piston remaining at the BDC and the additional extracted work energy that has supercooled the working fluid, the gas condenses into liquid droplets of the working fluid on solid surfaces inside the cylinder. Such droplets may form more easily near the inner surface of the piston cylinder. On the other hand, the gas near the center of the cylinder may still remain in the gaseous state but at a lower gas pressure due to the loss of gas molecules to condensation.

During period 814, the piston moves from its BDC to the TDC position in accordance with a nearly isentropic compression profile. This compression rate is slow enough to allow thermodynamic equilibrium to be or nearly be achieved throughout the compression. As a result, the gas pressure in the cylinder during expansion with very little condensed liquid is greater than the gas pressure during compression. During piston compression, the gas and the droplets of the working fluid are compressed back into the internal chamber of the cylinder where they can be heated and vaporized to repeat this cycle.

The PV diagram 800 illustrates experimentally measured non-equilibrium piston expansion profiles 806 of the pressure as compared to volume in the piston cylinder using a candidate HEEC working fluid, Octafluoropropane (R218). The profiles 806 which cannot currently be computed analytically with existing thermodynamic equilibrium models illustrate the critical crossing of the saturated liquid line to invoke a condensation and/or mass diffusion-limited transport process during the non-equilibrium piston expansion. As shown in FIG. 8, State 1 and State 2 are determined by experimentally measurement. The computed area under the expansion profiles 806 represents the extracted piston specific work energy. Subtracting this specific work energy from State 1 and using a thermodynamic equilibrium software package (e.g. REFPROP 2007 with NIST Standard Reference Database 23), all of the other cycle state points 812 (State 3) and 816 (State 4) and compression profile 814 can be estimated. For example, the cycle state point 812 (State 3) was derived knowing the specific volume at the cycle state point 808 (State 2) and subtracting the specific work energy (integrated area under an experimentally derived expansion period 806) from the internal energy of the cycle point 804 (State 1). The cycle point 816 (State 4) was estimated by assuming an isentropic compression from the cycle point 812 (State 3) to the specific volume at the cycle point 804 (State 1). The net work produced by this cycle is the integrated PV work area bounded by points 802, 806, 810, and 814.

Figure 9:
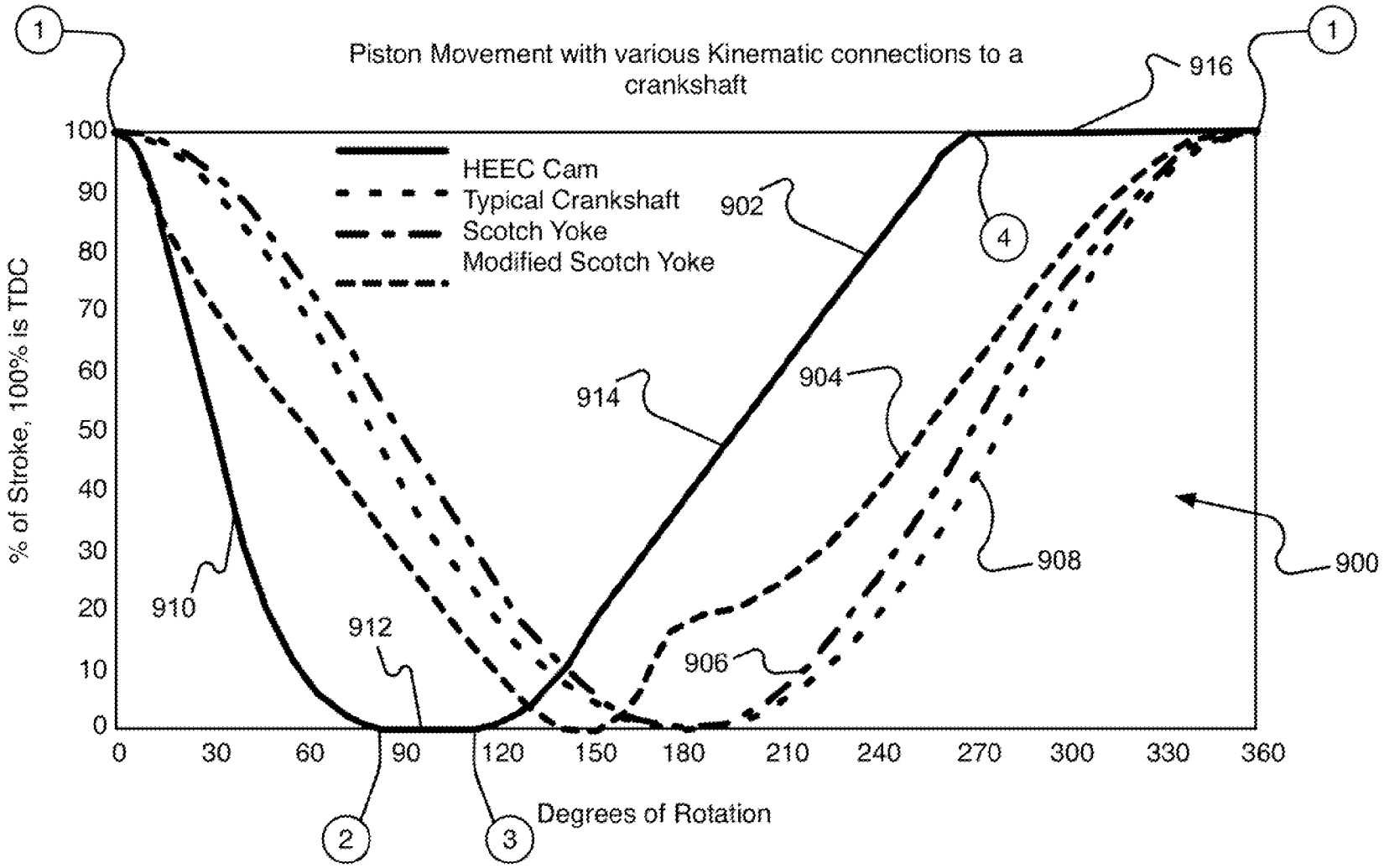
FIG. 9 illustrates a diagram of various non-sinusoidal piston movements for an example HEEC engine using exemplary alternative kinematic mechanisms compared to a conventional piston engine having sinusoidal piston movements.

FIG. 9 illustrates a diagram of various non-sinusoidal piston movements for an example HEEC engine using exemplary alternative kinematic mechanisms compared to a conventional piston engine having sinusoidal piston movements. The diagram 900 includes one or more graphs illustrating piston movements as a function of degrees of rotation of the driveshaft driven by the piston. Specifically, the diagram 900 includes: (1) a graph 902 that illustrates the piston movements as a function of degrees of rotation of the driveshaft driven by the piston for an example HEEC engine using a cam; (2) a graph 908 that illustrates the piston movements as a function of degrees of rotation of the driveshaft driven by the piston for an example HEEC engine using a typical driveshaft; (3) a graph 906 that illustrates the piston movements as a function of degrees of rotation of the driveshaft driven by the piston for an example HEEC engine using a scotch yoke; and (4) a graph 904 that illustrates the piston movements as a function of degrees of rotation of the driveshaft driven by the piston for an example HEEC engine using a modified scotch yoke.

More specifically, graph 902 illustrates the power cycle of an example HEEC engine wherein the piston moves through states 1-4 (e.g., as illustrated in FIG. 9 by numerals 1-4). The movement of the piston from state 1 to state 2 represents a period of rapid expansion 910 for the working fluid in the piston cylinder, causing the piston to move from TDC to BDC. The bottom dwell period 912 of the piston, wherein the piston is predominantly stationary at the BDC, allows some of the gas particles to condense into droplets of working fluid near the inner surface of the piston cylinder. During the compression period 914 of the HEEC engine, the piston moves from the BDC to the TDC in accordance with an isentropic profile. The period between states 4 and 1 is referred to as the top dwell period 916. During the top dwell period 916, the piston remains substantially at the TDC.

In many driveshaft scenarios, the driveshaft rotates at a nearly constant rpm—the degrees of rotation of the driveshaft are synchronized in time. In at least one implementation of the HEEC power cycle, however, expansion occurs over a shorter time interval than the compression stroke. This interval is dependent on the properties of a particular working fluid, the piston and cylinder geometry and, in general, rather complex condensation and mass transport phenomenon defining the slower equilibration rates with the formation of liquid droplets in a super-cooled working fluid. Experimental measurements using an instrumented research piston can be used to directly measure the various non-equilibrium changes in cylinder pressure. These measurements can be coupled with equilibrium thermodynamic analysis for cylinder pressure at the states 2 and 3 in order to derive an optimal piston temporal profile. Once this piston temporal profile is known, a number of kinematic and possibly electrodynamic mechanisms can be designed to produce the required non-sinusoidal motion.

An alternative method for optimizing the HEEC cycle could consist of building a research engine as shown in FIG. 2 and testing various cam profiles while measuring piston shaft work to determine the optimal cam profile for extracting net work out of a HEEC power cycle.

In addition to example kinematic mechanical mechanisms described above, which produce non-sinusoidal motion from constant rpm driveshaft rotation, another alternative mechanism for modifying rates of piston motion utilizes real-time changes in driveshaft rotation rates coupled with a conventional driveshaft piston engine. An example of such a device may include, without limitation, an electric motor/generator coupled to a conventional piston engine driveshaft such that the electric motor may vary the torsional load on the piston engine driveshaft. The electric motor/generator can effectively act as a regenerative brake to modify the rotation rates of a conventional piston engine driveshaft in order to produce similar profiles to those shown in FIG. 9. Due to the net work produced by creating a power cycle as shown in FIG. 8 through control of piston motion, the electric motor would produce net power with the application of heat applied to the insulated head block of the HEEC motor. An advantage of this electromechanical system may be the ability for a larger range of control of motion to optimize engine output efficiency.

In an alternative method, a combination of kinematic mechanisms and variations in engine output shaft RPM may be utilized to produce non-sinusoidal piston motion utilizing an output rotary shaft. In yet another alternative method for optimizing the HEEC cycle, a linear actuator may be used to control piston motion without a rotary shaft output. In such a case, the piston may include a magnet that induces current in the surrounding engine housing. By controlling the induced currents, the motion of the piston may be controlled and net electric current produced.

Figure 10:
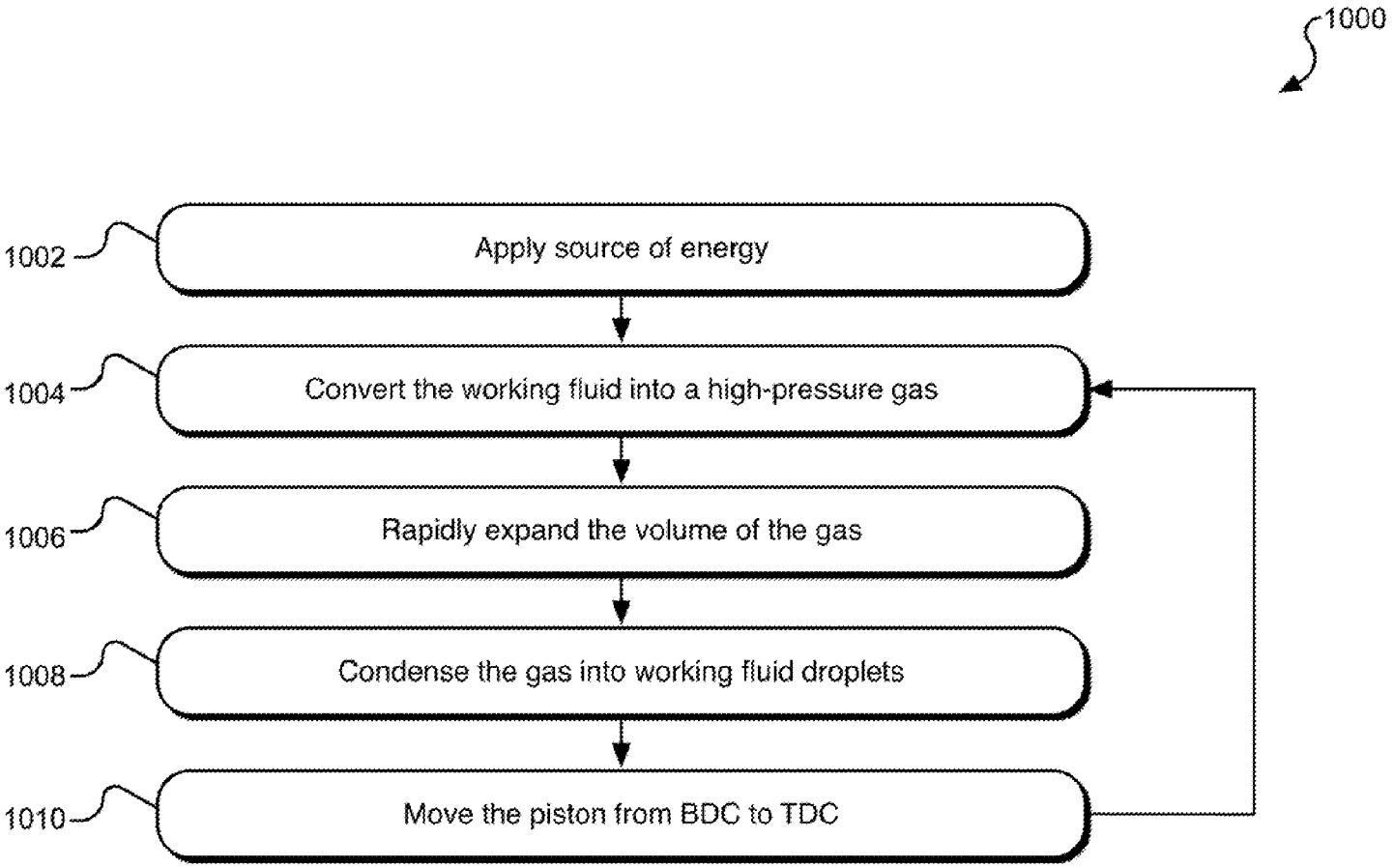
FIG. 10 illustrates a flow diagram for operation of an example HEEC engine.

FIG. 10 illustrates a flow diagram 1000 for operation of an example HEEC engine. Specifically, the flow diagram 1000 illustrates a method for operating a HEEC engine to cause the piston 402 to cycle through states 1-4. Even though the operations of the flow diagram 1000 are illustrated as being performed in a sequential manner, one or more of these operations may be performed concurrently. For example, in one implementation, the application of source of energy as illustrated by operation 1002 may be a continuous operation while operations 1004-1010 are being undertaken.

Specifically, an application operation 1002 applies heat or other source of energy to the working fluid (e.g., in an internal chamber 306 as illustrated in FIG. 3). The heat source may be applied via the heat inlet 310 and the micro-fluidic heat exchanger 302. Subsequently, a conversion operation 1004 converts the working fluid into a high-pressure gas. In an implementation of the HEEC engine disclosed herein, the conversion of working fluid into high-pressure gas may be accomplished by allowing a piston to dwell at a top dead center (TDC) location for a TDC dwell time that is approximately equal to ninety degrees of the rotation of the driveshaft attached to the piston through a kinematic mechanism.

Subsequently, an expansion operation 1006 rapidly expands the volume of the gas generated from the working fluid. In an implementation of the HEEC engine disclosed herein, the rapid expansion of gas is achieved by moving the piston towards a bottom dead center (BDC) to create a non-equilibrium expansion process of the working fluid by crossing a phase transition, such as a saturated gas phase transition during the expansion. Following the rapid expansion operation 1006, a condensation operation 1008 condenses the gas into droplets of the working fluid to lower cylinder pressure. In one implementation, the condensation of the gas into droplets of the working fluid may be achieved by allowing the piston to dwell at the BDC for a BDC dwell time that is just long enough to cause the metastable state of the gas to collapse back into an equilibrium state. Upon completion of the condensation operation 1008, a compression operation 1010 causes the piston to move toward its TDC position. In one implementation, the moving of the piston from its BDC position at the beginning of operation 1010 to its TDC position may be along an isentropic profile that allows the piston to collect working fluid droplets back into the internal chamber at the top of the cylinder.

Unlike combustion processes in internal combustion engines that rapidly produce high pressure gases in typically less than 10-100 milliseconds, the thermal conduction pathway into a HEEC working fluid tends to produce high pressure gases on much slower timescales. This slower generation of gas pressure relative to internal combustion engines may potentially limit the maximum rate over which the HEEC cycle can be repeated to generate power and lower the output power of the engine for a given engine size. To increase HEEC engine power output for a given size, augmenting heat transfer into the working fluid near TDC may be desirable. For example, enhancements in surface area to which the working fluid is exposed near TDC may increase the rate of heat exchange into the working fluid. Examples of this type of augmentation include without limitation forcing the piston working fluid near TDC into a micro-fluidic heat exchanger for flash evaporation or utilizing TDC cylinder profiles that naturally have large surface are to volume ratios.

A HEEC engine can utilize specialized piston working fluids that are ideally contained in a hermetically sealed system to prevent their inadvertent loss over time. Alternatively, mechanisms can be designed to allow recovery of lost working fluid through piston seals over time.

Figure 11A:
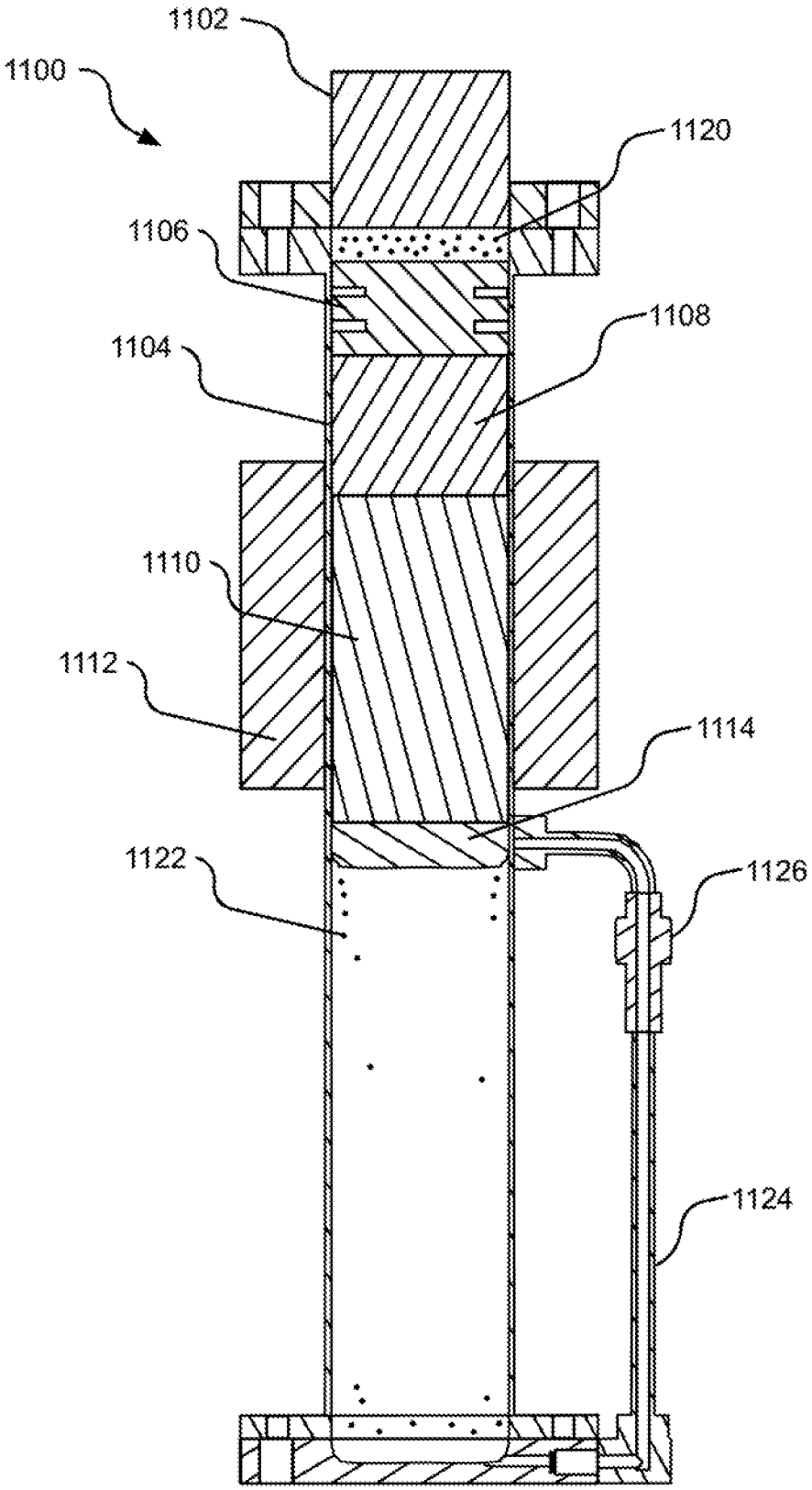
FIGS. 11A and 11B illustrate an example magnetically coupled sealed piston assembly 1100 that may be used in an implementation of a HEEC engine.
Figure 11B:
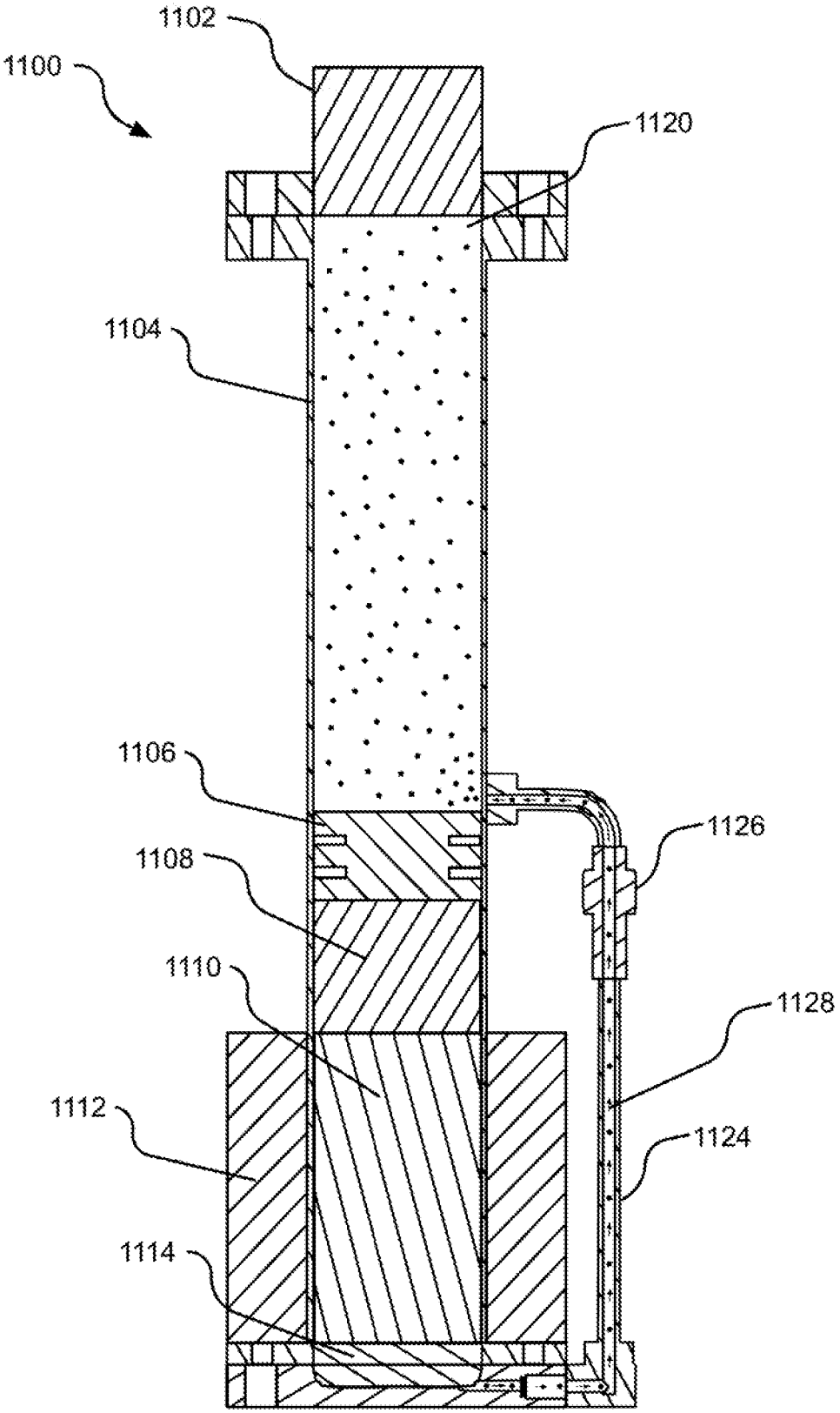

FIGS. 11A and 11B illustrate an example magnetically coupled sealed piston assembly 1100 that may be used in an implementation of a HEEC engine described herein. Specifically, FIG. 11A illustrates the piston assembly 1100 with the piston at the TDC. FIG. 11B illustrates the piston assembly 1100 with the piston at the BDC. The piston assembly 1100 also incorporates a fluid return to address seal leaks.

The piston assembly 1100 includes a cylinder head 1102 that is attached on top of the piston cylinder having a piston wall 1104. A piston having a piston top 1106 is located inside the piston cylinder. The piston further comprises a carbon foam insulator 1108 that attaches to the piston top 1106 and to an inner magnet 1110. In an embodiment of the piston assembly 1100, the inner magnet 1110 is magnetically coupled to an outer magnet 1112. The movement of the inner magnet 1110 according to the various cycles described herein may also move the outer magnet 1112 in sync with the inner magnet 1110. The outer magnet 1112 may be attached to a first end of a connecting rod (not shown herein), wherein a second end of such a connecting rod is connected to a kinematic mechanism described herein.

Furthermore, in an implementation of the piston assembly 1110, a plunger 1114 is attached at the bottom of the inner magnet 1110. The location of the piston inside the piston cylinder may be configured to provide an internal working fluid chamber 1120 on top of the piston head 1106. In this configuration, heat is transferred conductively through a solid boundary between the heat source coupled into the cylinder head 1102 into the working fluid chamber 1120. The cylinder head 1102 could, for example, be a heat exchanger designed to remove heat from a heated working fluid. Alternatively, the cylinder head 1102 could be a very conductive path tied directly to another heating source such as a combustion chamber. The working fluid chamber 1120 may be used to store the HEEC piston working fluid (e.g., that has properties as previously defined). Upon expansion of the working fluid due to application of heat or other energy, the piston may move vertically downwards towards the bottom of the piston assembly. While the piston is at the TDC as shown in FIG. 11A, generally there would not be any working fluid in the piston cylinder below the plunger. However, as shown in FIG. 11A by 1122, some particles of the working fluid may have leaked past the rings of the piston top and into the chamber below the plunger.

To collect such leakage of working fluid, the piston assembly 1100 may be provided with a return channel tube 1124. The return channel tube 1124 connects the bottom part of the piston cylinder with the middle part of the piston cylinder. The location where the top end of the return channel tube 1124 is connected to the piston cylinder is determined so that when the piston is at its BDC the top surface of the cylinder head 1102 is below the top connecting end of the return channel tube 1124. Because of such a configuration of the return channel tube 1124 when the piston is moving downwards in the piston cylinder, the plunger 1114 collects the droplets 1122 of the working fluid and forces them into the return channel tube 1124. The return channel tube 1124 is fitted with a check valve 1126 that allows one directional flow of the working fluid, specifically in the direction 1128 from the bottom of the piston cylinder towards the top of the piston cylinder.

Figure 12:
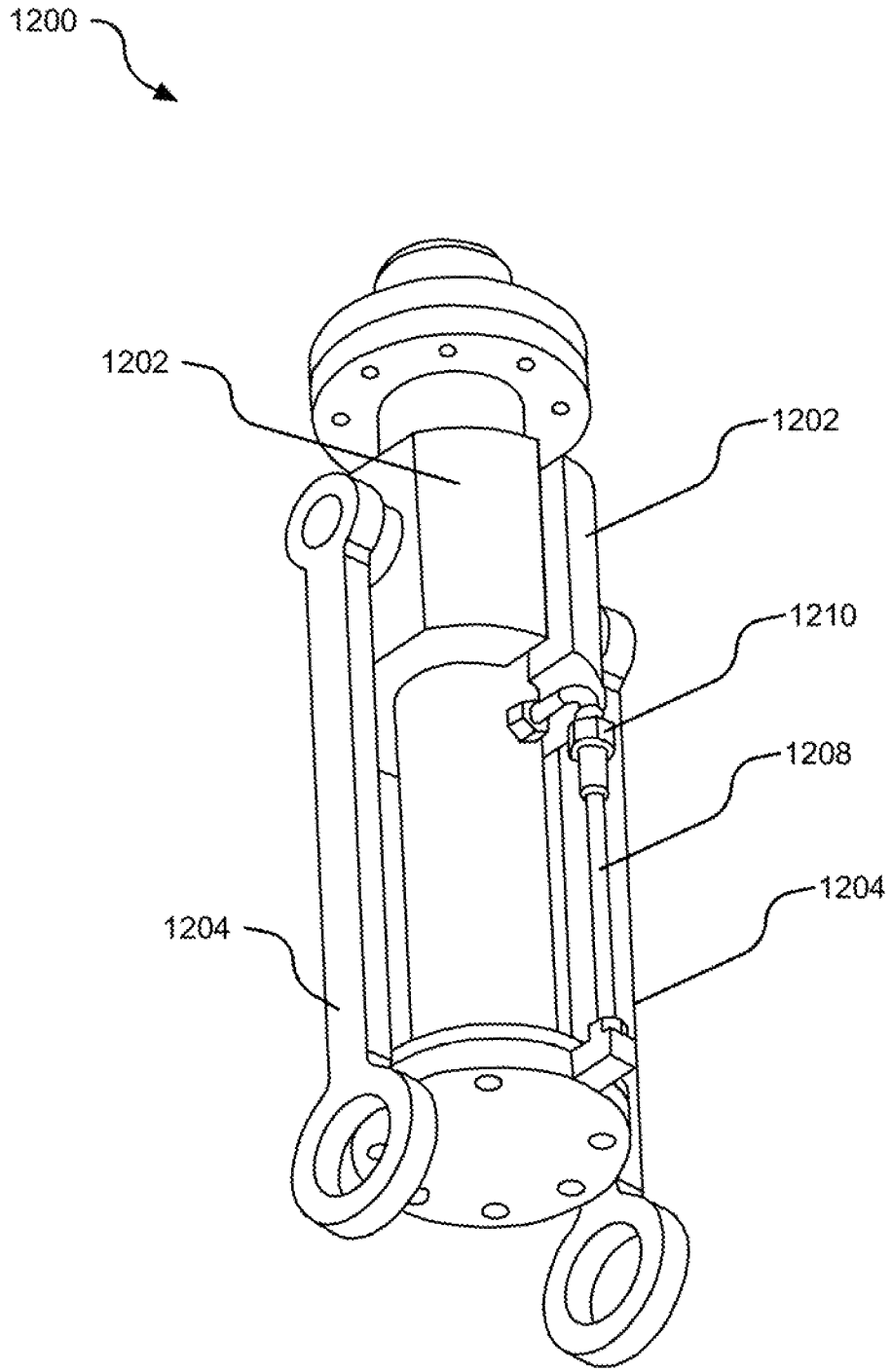
FIG. 12 illustrates a 3-dimensional view of an example piston assembly.

FIG. 12 illustrates a 3-dimensional view of an example piston assembly 1200, which also includes a fluid return. Specifically, FIG. 12 illustrates a piston assembly 1200 that includes outer magnets 1202 attached to first ends of connecting rods 1204. The lower ends of the connecting rods 1204 may be attached to a kinematic mechanism described herein. In one implementation, the movement of the inner magnets of the piston assembly 1200 may cause the outer magnets 1202 to move in a manner to cause a drive shaft attached to the kinematic mechanism to rotate. The piston assembly 1200 also shows return channel tube 1208 and check valve 1210 (e.g., corresponding to the return channel tube 1124 and the check valve 1126).

Figure 13:
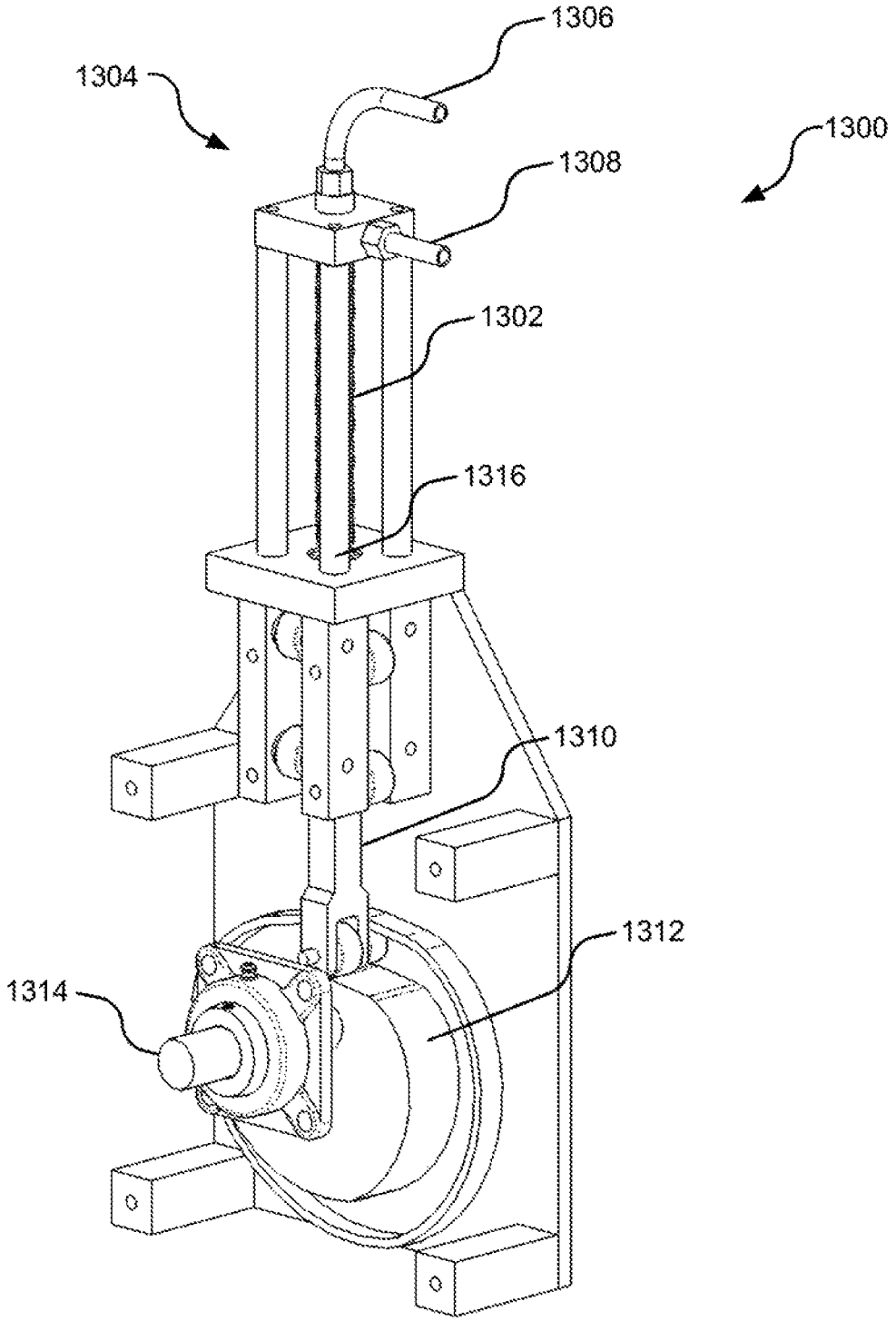
FIG. 13 illustrates an example energy conversion system including a bellows-sealed piston enclosed in bellows.

FIG. 13 illustrates an example energy conversion system 1300 including a bellows-sealed piston enclosed in a bellows 1302 (partially hidden by a support post 1316 of a heat exchanger head 1304). The heat exchanger head 1304 is positioned at one end of the energy conversion system 1300 and is equipped with an input 1306 and an output 1308 to allow the flow of a thermal transfer fluid (e.g., steam, hot water) through the heat exchanger head 1304. The fluid enters the heat exchanger head 1304 at the input 1306, flows down a center tube (not shown but enclosed in the bellows 1302), flows up an annular outer channel (not shown but enclosed in the bellows 1302), and exits the heat exchanger head 1304 at the output 1308.

Within the bellows 1302, the thermal transfer fluid is separated from the piston cylinder working fluid by a thermally conductive wall through which heat can transfer from the thermal transfer fluid to the working fluid, which is sealed within the bellows 1302. Expansion of the working fluid, resulting from the transferred heat, causes a piston shaft (partially enclosed and sealed in the bellows 1302) to move away from the heat exchanger head 1304. The piston shaft is connected to a linear-guided cam-crank input rod 1310, which drives a cam 1312 to turn a shaft 1314.

Figure 14:
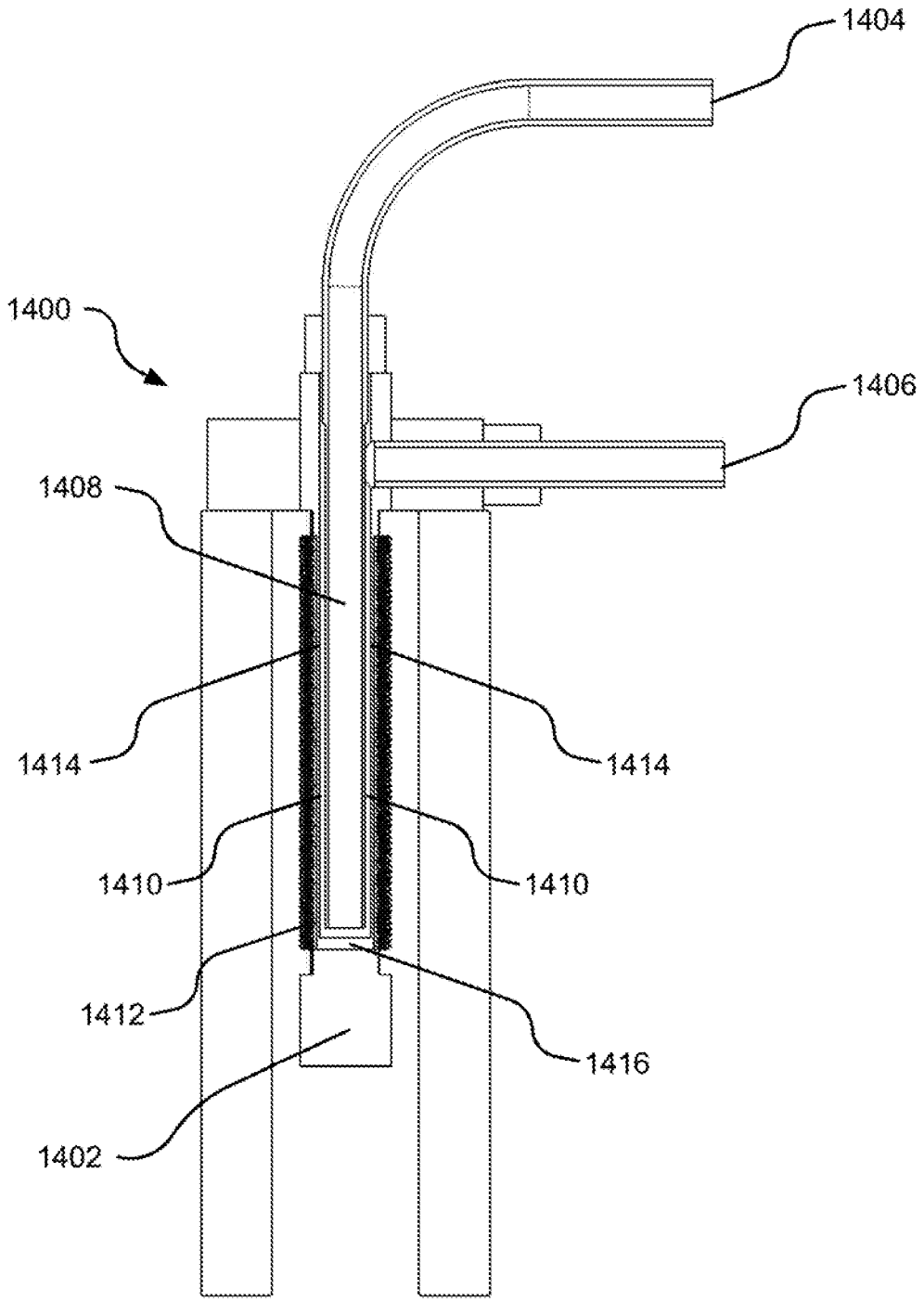
FIG. 14 illustrates a cross-sectional view of an example heat exchanger head combined with a contracted bellows-sealed piston shaft.

FIG. 14 illustrates a cross-sectional view of an example heat exchanger head 1400 combined with a contracted bellows-sealed piston shaft 1402. The heat exchanger element 1400 is equipped with an input 1404 and an output 1406 to allow the flow of a thermal transfer fluid (e.g., steam, hot water) through the heat exchanger head 1400. The fluid enters the heat exchanger head 1400 at the input 1404, flows down a center tube 1408, flows up an annular outer channel 1410, and exits the heat exchanger head 1400 at the output 1406.

Within bellows 1412, the thermal transfer fluid is separated from a working fluid by a thermally conductive wall, with side walls 1414 and base wall 1416, through which heat can transfer from the thermal transfer fluid, which flows through the center tube 1408 and the annular outer channel 1410, to the working fluid, which is sealed in the volume between the bellows 1412 and the thermally conductive wall (i.e., walls 1414 and 1416). Expansion of the working fluid, resulting from the transferred heat, causes the piston shaft 1402 to move away from the heat exchanger head 1400. The piston shaft 1402 is connected to a linear-guided cam-crank input rod (not shown in FIG. 14), which drives a cam (not shown in FIG. 14) to turn a shaft (not shown in FIG. 14).

The end of the bellows 1412 that is closest to heat exchanger head 1400 is sealed to the outer circumference of the annular outer channel 1410, and the end of the bellows 1412 that is closest to the piston shaft 1402 is sealed to the piston shaft 1402. The piston shaft 1402 is connected to the linear-guided cam-crank input rod and moves linearly away from the heat exchanger head 1400 during the expansion phase of the piston cycle and toward the heat exchanger head 1400 during the compression phase of the piston cycle.

The expansion phase results from the flash evaporation of the working fluid caused by the thermal transfer through the thermally conductive wall from the thermal transfer fluid. As previously described, the flash evaporation rapidly increases the pressure in the volume between the bellows 1412 and the thermally conductive walls, causing the bellows 1412 to expand and forcing the piston shaft 1402 away from the heat exchanger head 1400.

The compression phase results from the rotation of the cam, which forces the cam-crank input rod and piston shaft 1402 to move toward the heat exchanger head 1400. This motion causes the bellows 1412 to contract into the position shown in FIG. 14, thereby compressing the working fluid within the volume between the bellows 1412 and the thermally conductive walls in preparation for another flash evaporation and expansion phase.

Figure 15:
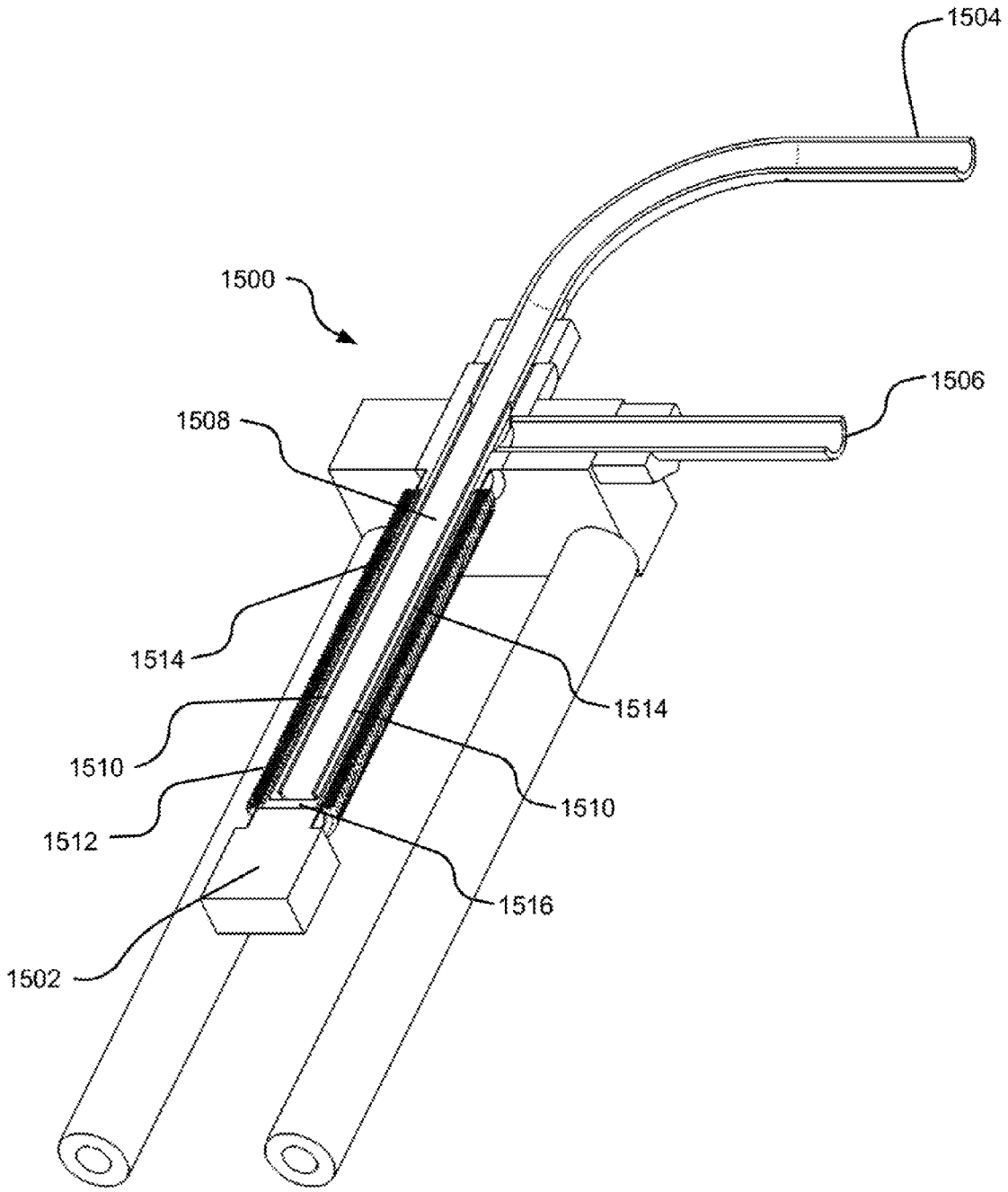
FIG. 15 illustrates a perspective view of an example heat exchanger combined with a contracted bellows-sealed piston shaft.

FIG. 15 illustrates a perspective view of an example heat exchanger 1500 combined with a contracted bellows-sealed piston shaft 1502. The heat exchanger element 1500 is equipped with an input 1504 and an output 1506 to allow the flow of a thermal transfer fluid (e.g., steam, hot water) through the heat exchanger head 1500. The fluid enters the heat exchanger head 1500 at the input 1504, flows down a center tube 1508, flows up an annular outer channel 1510, and exits the heat exchanger head 1500 at the output 1506.

Within bellows 1512, the thermal transfer fluid is separated from a working fluid by a thermally conductive wall, with side walls 1514 and base wall 1516, through which heat can transfer from the thermal transfer fluid, which flows through the center tube 1508 and the annular outer channel 1510, to the working fluid, which is sealed in the volume between the bellows 1512 and the thermally conductive wall (i.e., walls 1514 and 1516). Expansion of the working fluid, resulting from the transferred heat, causes the piston shaft 1502 to move away from the heat exchanger head 1500. The piston shaft 1502 is connected to a linear-guided cam-crank input rod (not shown in FIG. 15), which drives a cam (not shown in FIG. 15) to turn a shaft (not shown in FIG. 15).

The end of the bellows 1512 that is closest to heat exchanger head 1500 is sealed to the outer circumference of the annular outer channel 1510, and the end of the bellows 1512 that is closest to the piston shaft 1502 is sealed to the piston shaft 1502. The piston shaft 1502 is connected to the linear-guided cam-crank input rod and moves linearly away from the heat exchanger head 1500 during the expansion phase of the piston cycle and toward the heat exchanger head 1500 during the compression phase of the piston cycle.

The expansion phase results from the flash evaporation of the working fluid caused by the thermal transfer through the thermally conductive wall from the thermal transfer fluid. As previously described, the flash evaporation rapidly increases the pressure in the volume between the bellows 1512 and the thermally conductive walls, causing the bellows 1512 to expand and forcing the piston shaft 1502 away from the heat exchanger head 1500.

The compression phase results from the rotation of the cam, which forces the cam crank input rod and piston shaft 1502 to move toward the heat exchanger head 1500. This motion causes the bellows 1512 to contract into the position shown in FIG. 15, thereby compressing the working fluid within the volume between the bellows 1512 and the thermally conductive walls in preparation for another flash evaporation and expansion phase.

Figure 16:
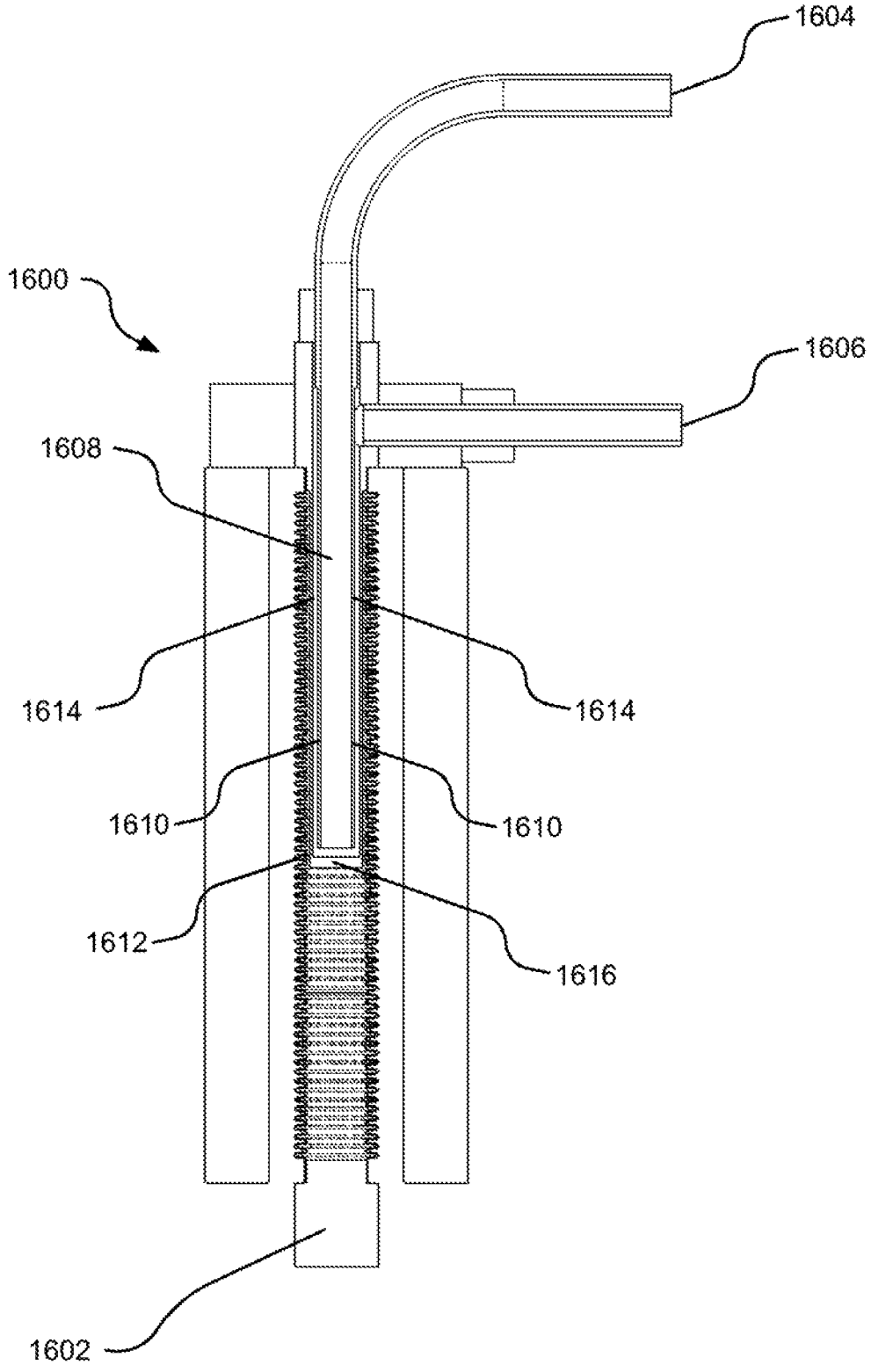
FIG. 16 illustrates a cross-sectional view of an example heat exchanger head combined with an expanded bellows-sealed piston shaft.

FIG. 16 illustrates a cross-sectional view of an example heat exchanger head 1600 combined with an expanded bellows-sealed piston shaft 1602. The heat exchanger element 1600 is equipped with an input 1604 and an output 1606 to allow the flow of a thermal transfer fluid (e.g., steam, hot water) through the heat exchanger head 1600. The fluid enters the heat exchanger head 1600 at the input 1604, flows down a center tube 1608, flows up an annular outer channel 1610, and exits the heat exchanger head 1600 at the output 1606.

Within bellows 1612, the thermal transfer fluid is separated from a working fluid by a thermally conductive wall, with side walls 1614 and base wall 1616, through which heat can transfer from the thermal transfer fluid, which flows through the center tube 1608 and the annular outer channel 1610, to the working fluid, which is sealed in the volume between the bellows 1612 and the thermally conductive wall (i.e., walls 1614 and 1616). Expansion of the working fluid, resulting from the transferred heat, causes the piston shaft 1602 to move away from the heat exchanger head 1600. The piston shaft 1602 is connected to a linear-guided cam-crank input rod (not shown in FIG. 16), which drives a cam (not shown in FIG. 16) to turn a shaft (not shown in FIG. 16).

The end of the bellows 1612 that is closest to heat exchanger head 1600 is sealed to the outer circumference of the annular outer channel 1610, and the end of the bellows 1612 that is closest to the piston shaft 1602 is sealed to the piston shaft 1602. The piston shaft 1'602 is connected to the linear-guided cam-crank input rod and moves linearly away from the heat exchanger head 1600 during the expansion phase of the piston cycle and toward the heat exchanger head 1600 during the compression phase of the piston cycle.

The expansion phase results from the flash evaporation of the working fluid causes by the thermal transfer through the thermally conductive wall from the thermal transfer fluid. As previously described, the flash evaporation rapidly increases the pressure in the volume between the bellows 1612 and the thermally conductive walls. This increase in pressure pushes the piston shaft 1402 down away from the heat exchanger head 1600. The bellows 1612 accommodate this motion by axially expanding.

The compression phase results from the rotation of the cam, which forces the cam-crank input rod and piston shaft 1602 to move toward the heat exchanger head 1600. This motion causes the bellows 1612 to contract into the position shown in FIG. 14 or 15, thereby compressing the working fluid within the volume between the bellows 1612 and the thermally conductive walls in preparation for another flash evaporation and expansion phase.

Figure 17:
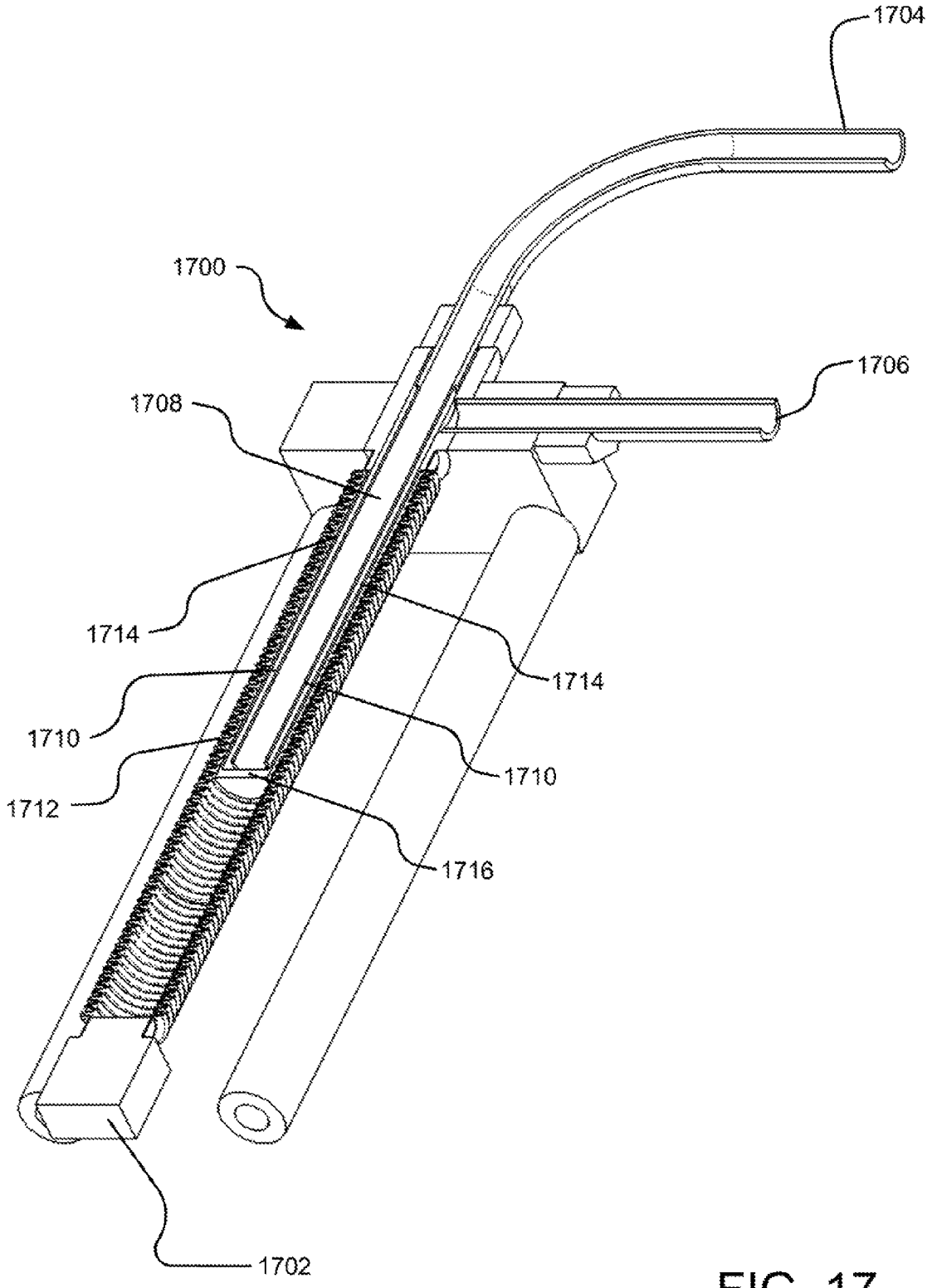
FIG. 17 illustrates a perspective view of an example heat exchanger combined with an expanded bellows-sealed piston shaft.

FIG. 17 illustrates a perspective view of an example heat exchanger 1700 combined with an expanded bellows-sealed piston shaft 1702. The heat exchanger element 1700 is equipped with an input 1704 and an output 1706 to allow the flow of a thermal transfer fluid (e.g., steam, hot water) through the heat exchanger head 1700. The fluid enters the heat exchanger head 1700 at the input 1704, flows down a center tube 1708, flows up an annular outer channel 1710, and exits the heat exchanger head 1700 at the output 1706.

Within bellows 1712, the thermal transfer fluid is separated from a working fluid by a thermally conductive wall, with side walls 1714 and base wall 1716, through which heat can transfer from the thermal transfer fluid, which flows through the center tube 1708 and the annular outer channel 1710, to the working fluid, which is sealed in the volume between the bellows 1712 and the thermally conductive wall (i.e., walls 1714 and 1716). Expansion of the working fluid, resulting from the transferred heat, causes the piston shaft 1702 to move away from the heat exchanger head 1700. The piston shaft 1702 is connected to a linear-guided cam-crank input rod (not shown in FIG. 17), which drives a cam (not shown in FIG. 17) to turn a shaft (not shown in FIG. 17).

The end of the bellows 1712 that is closest to heat exchanger head 1700 is sealed to the outer circumference of the annular outer channel 1710, and the end of the bellows 1712 that is closest to the piston shaft 1702 is sealed to the piston shaft 1702. The piston shaft 1702 is connected to a linear-guided cam-crank input rod (not shown in FIG. 17) and moves linearly away from the heat exchanger head 1700 during the expansion phase of the piston cycle and toward the heat exchanger head 1700 during the compression phase of the piston cycle.

The expansion phase results from the flash evaporation of the working fluid causes by the thermal transfer through the thermally conductive wall from the thermal transfer fluid. As previously described, the flash evaporation rapidly increases the pressure in the volume between the bellows 1712 and the thermally conductive walls. This increase in pressure applies force to push the piston down or alternatively cause the bellows 1712 to axially expand and force the piston shaft 1702 away from the heat exchanger head 1700.

The compression phase results from the rotation of the cam, which forces the crank input rod and piston shaft 1702 to move toward the heat exchanger head 1700. This motion causes the bellows 1712 to contract into the position shown in FIG. 14 or 15, thereby compressing the working fluid within the volume between the bellows 1712 and the thermally conductive walls in preparation for another flash evaporation and expansion phase.

Figure 18:
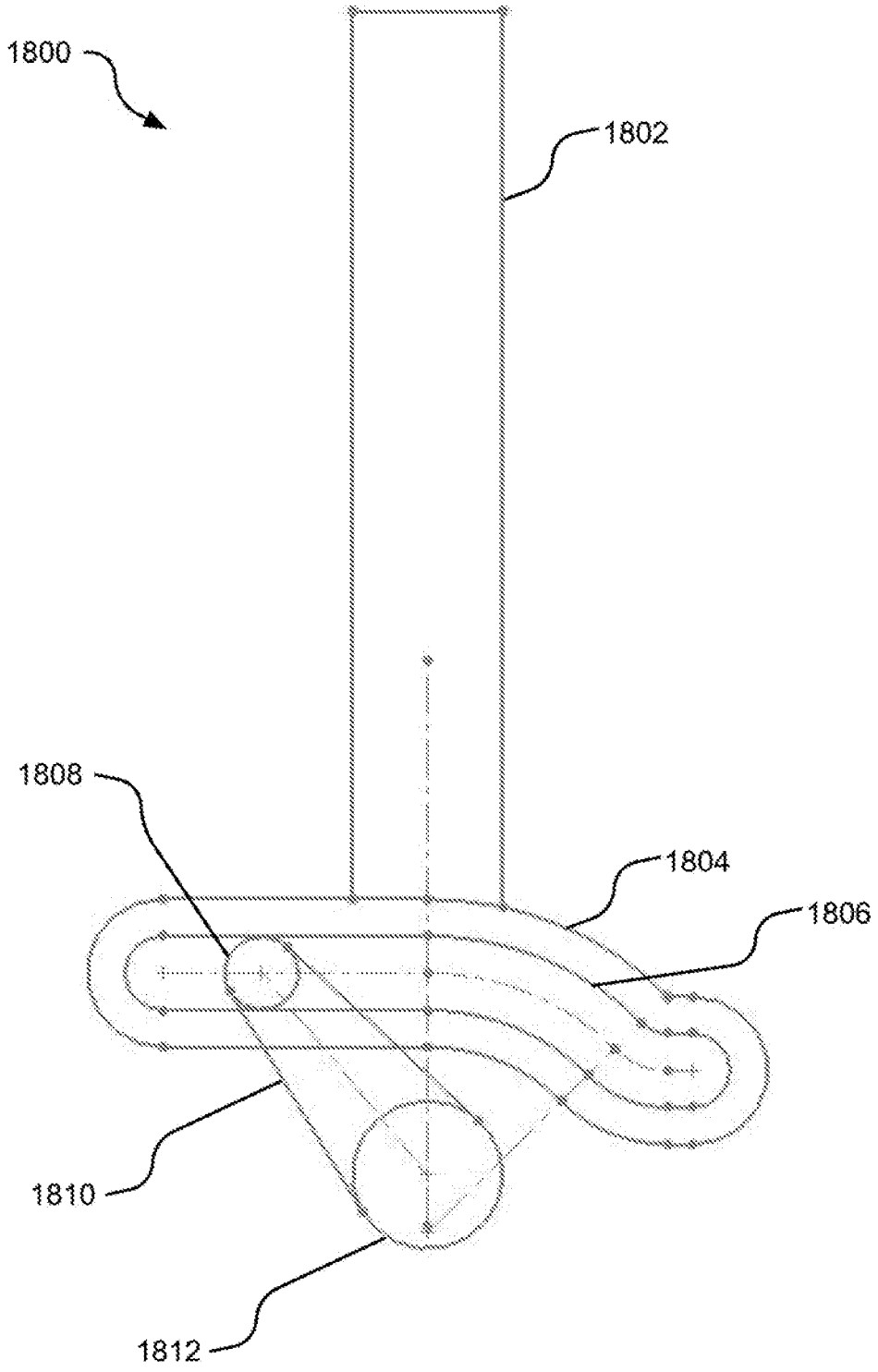
FIG. 18 illustrates a kinematic mechanism that may be used in an example HEEC engine.

FIG. 18 illustrates a kinematic mechanism that may be used in an example HEEC engine, although it should be understood that other kinematic mechanisms may be employed. The example kinematic mechanism is configured to produce a faster expansion stroke compared to a compression stroke, although different characteristics may be obtained depending on the system's requirements, Unlike a conventional piston engine that produces near sinusoidal motion utilizing a piston rod that is fixed but free to rotate at both the driveshaft pin and piston pin, alternative kinematic mechanisms may allow the driveshaft and/or piston pins to slide in a prescribed pattern to cause the piston motion to deviate from near sinusoidal motion. FIG. 18 illustrates functioning of a scotch yoke assembly 1800 that includes a piston 1802. Additionally, the scotch yoke assembly 1800 includes a kinematic mechanism 1804 that is coupled to piston 1802 with a slot 1806 that engages a pin 1808. The pin 1808 is connected via rotating part 1810 to a driveshaft 1812. The geometry of the kinematic mechanism 1804 may be configured to convert linear motion of the piston 1802 into rotational movement of a driveshaft 1810. Specifically, the geometry of the kinematic mechanism 1804 may be configured so that the piston 1802 has a top-dwell time that allows conversion of a working fluid in the piston cylinder into a high-pressure gas. Additionally, the shape of the kinematic mechanism 1804 may also allow the piston to cause rapid expansion of the gas in the piston cylinder as the piston 1802 moves towards its bottom dead center (BDC) position. Furthermore, the shape of the kinematic mechanism 1804 may also allow the piston 1802 to have a bottom dwell time long enough to cause the metastable thermodynamic state of gas in the piston cylinder to collapse back into an equilibrium state so as to condense the gas into working fluid droplets and reduce the pressure in the piston cylinder. As illustrated in FIG. 18, the piston 1802 is close to its TDC position.

Figure 19:
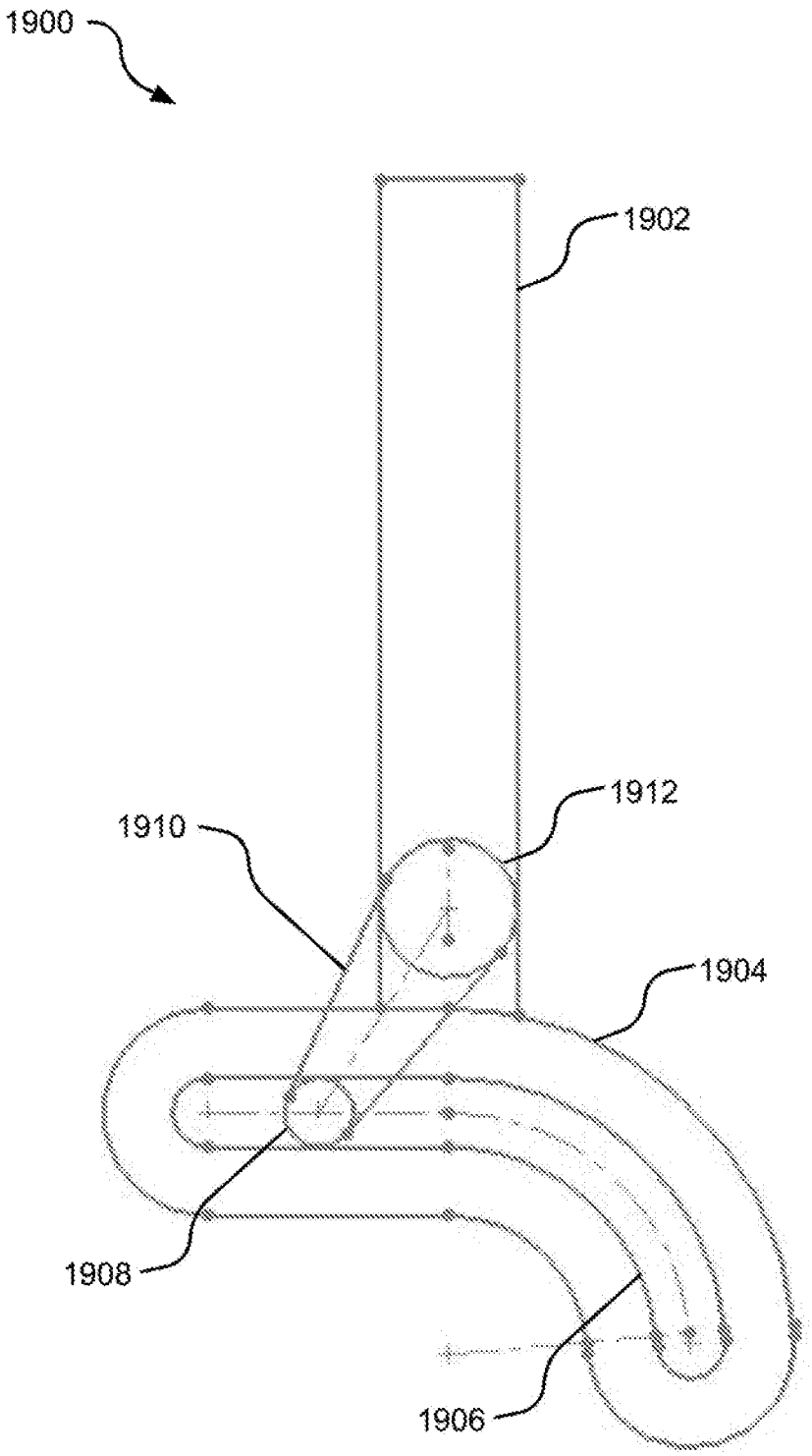
FIG. 19 illustrates an alternate kinematic mechanism that may be used in an example HEEC engine.

FIG. 19 illustrates an alternative kinematic mechanism that may be used in an example HEEC engine. The example kinematic mechanism is configured to produce a faster expansion stroke compared to a compression stroke, although different characteristics may be obtained depending on the system's requirements. Specifically, FIG. 19 illustrates functioning of a scotch yoke assembly 1900 that includes a piston 1902. Additionally, the scotch yoke assembly 1900 includes a kinematic mechanism 1904 that is coupled to piston 1902 with a slot 1906 that engages a pin 1908. The pin 1908 is connected via rotating part 1910 to a driveshaft 1912. The geometry of the kinematic mechanism 1904 may be configured to convert linear motion of the piston 1902 into rotational movement of a driveshaft 1810. Specifically, the geometry of the kinematic mechanism 1904 may be configured so that the piston 1902 has a top-dwell time that allows conversion of a working fluid in the piston cylinder into a high-pressure gas. Additionally, the shape of the kinematic mechanism 1904 may also allow the piston to cause rapid expansion of the gas in the piston cylinder as the piston 1902 moves towards its bottom dead center (BDC) position. Furthermore, the shape of the kinematic mechanism 1904 may also allow the piston 1902 to have a bottom dwell time long enough to cause the metastable thermodynamic state of gas in the piston cylinder to collapse back into an equilibrium state so as to condense the gas into working fluid droplets and reduce the pressure in the piston cylinder. As illustrated in FIG. 19, the piston 1902 is close to its BDC position.

In the following description, for the purposes of explanation, numerous specific details are set forth in order to provide a thorough understanding of the present invention. It will be apparent, however, to one skilled in the art that the present invention may be practiced without some of these specific details. For example, while various features are ascribed to particular embodiments, it should be appreciated that the features described with respect to one embodiment may be incorporated with other embodiments as well. By the same token, however, no single feature or features of any described embodiment should be considered essential to the invention, as other embodiments of the invention may omit such features.

The above specification, examples, and data provide a complete description of the structure and use of exemplary embodiments of the invention. Since many embodiments of the invention can be made without departing from the spirit and scope of the invention, the invention resides in the claims hereinafter appended. Furthermore, structural features of the different embodiments may be combined in yet another embodiment without departing from the recited claims.

What is claimed is:

1. An energy conversion system, comprising:

a piston assembly including a variable volume substantially sealed cylinder;

a working fluid stored within the substantially sealed cylinder; and a kinematic mechanism attached to the piston assembly and configured to provide piston expansion at a rate that outpaces a rate of condensation of the working fluid and in a manner sufficient to create one or more meta-stable thermodynamic states of the working fluid during an expansion stroke of a power cycle for the energy conversion system.

2. The energy conversion system of claim 1, wherein the kinematic mechanism is further configured to generate a compression stroke wherein the working fluid inside the piston assembly achieves a thermodynamic equilibrium state at a distinct state point during the compression stroke.

3. The energy conversion system of claim 2, wherein the kinematic mechanism is further configured to provide a dwell time at a bottom dead center position of the piston assembly sufficient to allow the meta-stable thermodynamic state to collapse into the thermodynamic equilibrium state so as to condense a portion of gaseous working fluid into a liquid phase and reduce pressure within the substantially sealed cylinder.

4. The energy conversion system of claim 1, wherein the kinematic mechanism is further configured to provide a dwell time at a top dead center position of the piston assembly to allow for heating of the working fluid prior to the expansion stroke.

5. The energy conversion system of claim 3, wherein the working fluid has a liquid/gas phase boundary that is traversed during the dwell time at the bottom dead center position of the piston assembly.

6. The energy conversion system of claim 1, wherein the working fluid includes at least one of a refrigerant; a salt; and a metal.

7. The energy conversion system of claim 1, wherein the kinematic mechanism includes at least one of a cam lobe mechanism and a Scotch yoke mechanism.

8. The energy conversion system of claim 2, wherein the kinematic mechanism includes an electromagnetic system.

9. The energy conversion system of claim 1, wherein the substantially sealed cylinder is convectionally attached to a micro-fluidic heat exchanger.

10. The energy conversion system of claim 9, wherein the micro-fluidic heat exchanger is configured to convey heat from an external source to the working fluid.

11. The energy conversion system of claim 1, wherein the kinematic mechanism includes a cam lobe mechanism and a cam lobe of the mechanism is attached to an output driveshaft driving at least one of an electricity generator and a motor.

12. The energy conversion system of claim 1, wherein the substantially sealed cylinder is hermetically sealed.

13. The energy conversion system of claim 1, wherein the piston assembly includes a piston in the substantially sealed cylinder and further comprising:

a return tube with a first end attached to a low pressure side of the piston in the substantially sealed cylinder and a second end providing a fluid return to a high pressure side of the piston in the substantially sealed cylinder; and a check valve attached to the return tube, wherein the check valve is configured to prevent flow of the working fluid through the return tube towards the low pressure side of the piston in the substantially sealed cylinder.

14. A method of extracting work from a metastable power cycle comprising:

applying a source of thermal energy a substantially sealed variable volume container filled with a working fluid;

allowing the substantially sealed container to dwell at a minimum volume for a time sufficient to convert the working fluid into a one or both of a high-pressure gas and a supercritical fluid via the applied thermal energy;

expanding the substantially sealed container volume at a rate that outpaces a rate of condensation of the working fluid and in a manner sufficient to create one or more meta-stable thermodynamic states for the working fluid, wherein the expansion operation drives a reciprocating kinematic mechanism connected to the substantially sealed container to extract the work;

allowing the substantially sealed container to dwell at a maximum volume for a time sufficient to cause the meta-stable thermodynamic state at the maximum volume to collapse back into an equilibrium thermodynamic state so as to condense a portion of the gas into a liquid phase and reduce pressure within the substantially sealed container; and compressing the substantially sealed container volume return the substantially sealed container to the minimum volume.

15. The method of claim 14, wherein the working fluid includes at least one of a refrigerant, a salt, and a metal.

16. An energy conversion system comprising:

an energy conversion mechanism that generates power through volumetric expansion of a working fluid substantially sealed within a variable volume container;

a working fluid stored within the container; and a kinematic mechanism attached to the energy conversion mechanism and configured to provide volume expansion of the working fluid at a rate that outpaces a rate of condensation of the working fluid and in a manner sufficient to create one or more meta-stable thermodynamic states of the working fluid during an expansion period of a power cycle for the energy conversion system.

17. The energy conversion system of claim 16, wherein the kinematic mechanism is further configured to generate a compression period wherein the working fluid inside the energy conversion mechanism achieves a thermodynamic equilibrium state at a distinct state point during the compression stroke.

18. The energy conversion system of claim 16, wherein a majority of the working fluid is in a non-equilibrium thermodynamic state during a majority of the volume expansion of the working fluid.

19. The energy conversion system of claim 1, wherein the expanding working fluid produces a continuum of bulk, meta-stable, non-equilibrium thermodynamic states during the volume expansion of the working fluid.

20. The energy conversion system of claim 19, wherein the continuum of bulk, meta-stable, non-equilibrium thermodynamic states is caused by the working fluid undergoing a time delayed fluid phase change.

21. The energy conversion system of claim 1, wherein a saturated fluid phase transition during the piston expansion creates one or both of a condensation and mass diffusion transport limited process, wherein a rate that the gaseous working fluid condenses into a two-phase fluid during the expansion stroke is slower than a condensation rate in isentropic expansion of the working fluid under identical initial pressure and specific volume constraints.

22. The energy conversion system of claim 19, wherein cylinder pressure is higher with the continuum of bulk, meta-stable, non-equilibrium thermodynamic states than if gas molecules underwent condensation.

23. The energy conversion system of claim 1, wherein a volume rate of change in the cylinder outpaces a rate of mass transport of gas molecules to liquid condensation nuclei within the working fluid.

24. The energy conversion system of claim 2, wherein the working fluid inside the cylinder does not achieve bulk, metastable, non-equilibrium thermodynamic conditions throughout the compression stroke.

25. The energy conversion system of claim 2, wherein the compression stroke is isentropic.

26. The energy conversion system of claim 2, wherein the working fluid pressure at a particular specific volume in the cylinder during the compression stroke is less than the working fluid pressure at the particular specific volume during the expansion stroke.

27. The energy conversion system of claim 1, wherein the working fluid isentropic expansion profile traverses a phase change boundary during the piston expansion.

* * * * *